US006012594A

United States Patent [19]

Heinz

[11] Patent Number: 6,012,594

[45] Date of Patent: Jan. 11, 2000

[54] FREE-STANDING POSTER PORTFOLIO

[76] Inventor: Ted Heinz, 33694 Colgate Dr., Union City, Calif. 94587

[21] Appl. No.: 09/218,430

[22] Filed: Dec. 22, 1998

Related U.S. Application Data

[63] Continuation-in-part of application No. 08/895,346, Jul. 16, 1997, which is a continuation-in-part of application No. 08/724,011, Sep. 30, 1996, Pat. No. 5,890,604.

[51] Int. Cl.[7] ..... A47F 7/16

[52] U.S. Cl. ..... 211/46; 211/106; 312/184; 281/33

[58] Field of Search ..... 211/45, 46, 47, 211/48, 1.3, 94.02, 96, 99, 100, 106, 119; 312/183, 184, 258, 259; 40/1, 610, 611; 190/900; 281/33, 37, 44

[56] References Cited

U.S. PATENT DOCUMENTS

| | | | |
|---|---|---|---|
| 1,581,267 | 4/1926 | Hutchins | 40/1 |
| 1,687,859 | 10/1928 | Fontaine | 312/184 |
| 2,283,584 | 5/1942 | Sloan | 281/33 X |
| 2,602,252 | 7/1952 | Shinn | 40/1 X |
| 2,675,130 | 4/1954 | Dore | 211/119 X |
| 3,295,471 | 1/1967 | Cook | 211/106 X |
| 3,544,134 | 12/1970 | Sibley | 281/33 |
| 4,318,471 | 3/1982 | Hutton | 281/33 X |
| 4,420,270 | 12/1983 | Rossello | 281/33 X |
| 5,588,543 | 12/1996 | Finger | 211/106 X |

*Primary Examiner*—Peter M. Cuomo
*Assistant Examiner*—James O. Hansen
*Attorney, Agent, or Firm*—Paul F. Schenck

[57] ABSTRACT

A free-standing chart portfolio for display, storing, file acessing and transporting hanging sheets of documents, such as posters and charts (or other large graphics). The portfolio includes one or more storage frame, for receiving sheets having two flat flexible plastic tabs with holes and slits attached to the back top edge. The spacing of the tabs matches the width of the storage frame. The frame can be used in two positions, a storage position and a file access position. In the storage position the sheets are packed tightly. The storage frame is removable from the portfolio to change the position or for transportation to a different location. The portfolio has two hinged covers, which serve as protective covers, or, when opened, as stands of the portfolio.

7 Claims, 24 Drawing Sheets

FREE-STANDING POSTER PORTFOLIO

This is a continuation-in-part application of my application Ser. No. 08/895,346, filed Jul. 16, 1997, which is a continuation-in-part application of my application Ser. No. 724,011, filed Sep. 30, 1996, now U.S. Pat. No. 5,890,604.

BACKGROUND OF THE INVENTION

The present invention relates to systems for storage of graphics, charts, maps, posters and similar objects, which are referenced in the following and in the claims as posters or charts without restricting the objects which can be stored using the present invention to the same. It is particularly applicable for posters and charts ranging from 15" to 30" in width and from less than 10" to more than 40" in height. This invention is of particular importance for use where many different didactic and decorative posters and charts are displayed and used as part of an ongoing curriculum for instructive, illustrative purpose. Because they are often changed to support the progression of the learning process, it is important to have an efficient and easy system for handling and storing these relatively large objects. This invention provides a new type of movable poster portfolio storage using tab/hook device for hanging posters and charts or the like in a foldable free-standing stand which allows to establish an order to re-organize and display stored posters. Furthermore, a tool is disclosed for attaching tabs/hooks to a poster, chart or the like object. In the following disclosure of the present invention the tab/hook device is referenced as a tab without diminishing its feature as a hook for hanging an object on a rack.

A storage is disclosed, which exhibits significant features as a device for storing objects, as a device for transporting such objects, a supply storage for easily selecting and removing one or more objects from a group of stored objects as well as using it as a hanger during selective display of individual objects out of a series of objects.

Furthermore, the free-standing poster portfolio is designed for protecting stored objects during shipment from one location to another.

DISCUSSION OF PRIOR ART

There are existent various methods for dealing with storage and retrieval of posters and charts. It is usually believed best to store posters laying flat on large flat shelves. But such flat files are generally heavy and difficult to transport. Sometimes very large envelopes or cardboard folders are used for transportation. However, placing and removing posters and charts from such envelops is time consuming.

In another often user method posters and charts are rolled up for shipment to another location. Storage of these rolls can become at best haphazard; and it is difficult to handle the posters or charts after they are unpacked because they tend to roll back up.

OBJECTIVES OF THE INVENTION

It is an object of the present invention to provide for a means for shipment of posters, charts and the like.

It is an object of the present invention to provide for a storage, file access, display and transportation device for posters, charts and the like.

It is another object of the invention to provide for space saving shipment enclosure for flat objects such as posters, charts and the like which is easily converted to a display and storage facility.

It is another object of the invention to provide for space saving shipment enclosure for flat objects such as posters, charts and the like which is easily converted to a display and storage facility using a removable hanging rack.

DESCRIPTION OF THE INVENTION

The present invention uses a foldable poster carrier with a poster hanging rack removably mounted inside the carrier.

In the present invention one or more flat bendable plastic tabs, acting as hooks, which easily open and automatically close, are attached to the top edge of the posters or charts. These tabs are spaced at a preestablished intervals and preferably centered and symmetrical at the top edge of the poster or chart. (Alternatively one long tab, including one or more hooks, may be used spanning the same distance at the top of the poster or chart.)

In order to hang a poster or chart, the hanging tabs are snapped onto the rods, rings or frame of a holding rack. Because the posters and charts are hanging they are easy to separate and review for retrieval of a particular one. And because the tabs are flexible, individual posters or charts may easily be removed and placed in any other position within the established sequence of posters or charts. As an organizing aid, dividers may be introduced like in a file, and the tabs can be provided in various distinguishing colors. This works especially well if viewed from the top. The hanging posters or charts, separated by the categories established by the dividers, can be slid and separated on the rack so as to see and confirm the category and location of any particular posters or charts desired.

In many classrooms a variety of didactic and decorative posters and charts are displayed and used as part of an ongoing curriculum and periodically must be changed to support the progression of the learning process. Because of many demands in the schools, space, time, and economy are of utmost importance. This invention provide for a means for hanging posters and charts simply and flexibly in a way that permits teachers to easily organize (and reorganize) for storage and retrieval. Individual posters or charts may be quickly removed or returned to any position within the sequence of hanging posters or charts. The tab is generally very close to the same thickness as most charts and posters; thus, very little space is needed. The difference being that: when stacked, they use considerable valuable horizontal space, whereas, when hanging, they do not waste space, rather, a manageable vertical slice is required to safely and economically store the posters or charts. This compact set of hanging posters or charts can be placed against the wall or within the parameters of a chart rack. The hanging tabs do not distract from the normal use of the posters when put on display.

Large folders could be hung in which any number of large flat materials are filed, such as bulletin board materials, student artwork, etc. Heavy objects can be hung using thicker tabs or multiple tabs in the same place.

One of the elements of this invention is the flexible tab attached to the top edge of a poster or chart. Another element of this invention is a hanging frame on which the tabs snap to support the hanging poster or chart. However during display of all or selected ones of the posters or charts, the same can be hung from a support or a wall using one or two rods or even one or more nails or push tacks or push pins spaced properly apart in a wall. A tab consists of a thin plastic (in the preferred embodiment Mylar™ plastic 0.010" thick for posters and individual display charts, and 1/32" polycarbinate plastic for flip charts). Tabs have one centrally located hole, or a plurality of symmetrically arranged holes, each hole being large enough to accommodate, with some extra space, the diameter of the rod on which it is to hang. The tab is split, from the top or side in a straight or curved line, to the hole. This allows the rod to pass along the slit (which flexes open) and into the hole. The tab then snaps back to its original position enclosing and holding onto the rod. There are three types of tabs:

1) individual (used in pairs for items 15" and greater);
2) long (for single rod or to provide added support); and
3) heavy duty with elongated slot shaped hole (for flip charts).

Within each of these types a variety of shapes are possible:

more rounded than square;

with bulge around hole of long tab/hook and thinner in rest of extension; etc.

The shape of the tabs do not effect the basic principles of this invention: thin tabs/hooks which allow the insertion of a rod by way of a flexible slit (or wider opening) into an area which is closed over the rod and rigid enough to support the weight of the poster or chart. The tabs in the preferred embodiment are transparent. However, for classifying the attached chart or poster, colored tabs can be used. Tabs are attached with adhesive tape (transparent in the preferred embodiment) in such a way that the tab but-up against the top edge of the poster or chart and an adhesive bridges from a tab surface to the surface of the attached chart or poster.

In the preferred embodiment the tab has an area for receiving the adhesive tape and an area in which the opening and the slit is located. However the adhesive tape may be attached to the whole tab if provisions are made to cut out the hanging opening and the slit. In another version the tab may have a recessed area with an adhesive material which can be attached directly to a chart or poster. However, such a design requires a thicker tab, which lowers the efficiency of the hanging storage. For high efficiency storage the thickness of a tab is generally very close to the thickness of the charts and posters and it should not exceed double the thickness of a chart or poster attached to it. This allows the posters and charts to be hang together and to occupy practically no more volume than if the posters and charts were stacked flat without the tab/hooks. At a thickness of no more than 1/64" fifty to sixty posters hang easily within each inch of rod space.

Various aids for correct positioning and mounting are possible. It is important to have guides which determine the exact distance (14" in the preferred embodiment) between the tabs, as well as for centering the tabs along the top edge of the poster or chart. Also, precut clear adhesive tape on release paper may be provided; or, clear adhesive tape may be integrated into the product during manufacture with release paper to be removed just before attaching the tab/hook in the correct position.

Another part of the arrangement for storing posters or the like is a rack, including a frame for receiving the hanging tabs or hooks, and a mounting plate for holding the frame to a wall in one of two positions, one position for space saving storage, the other for expanding the stored group of posters for accessing posters in the group of posters.

In the poster portfolio of the present invention the frame can be secured to the back of the portfolio in two different places and each two different ways. The various methods of mounting a frame to the back provides for a broad spectrum of applications.

SHORT DESCRIPTION OF THE DRAWINGS

FIGS. 8*a* through 8*e* are illustrations of tabs with alternative types of slits.

Figure 9A:
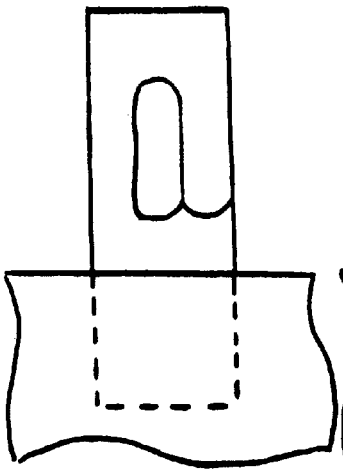
Figure 9B:
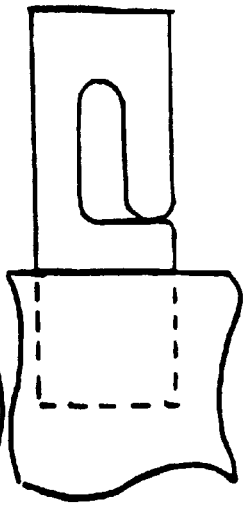
Figure 9C:
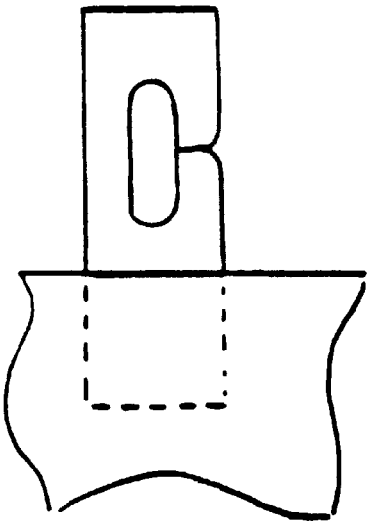

FIGS. 9*a* through 9*c* are illustrations of tabs with elongated openings and alternative slits for use with flip charts.

Figure 10:
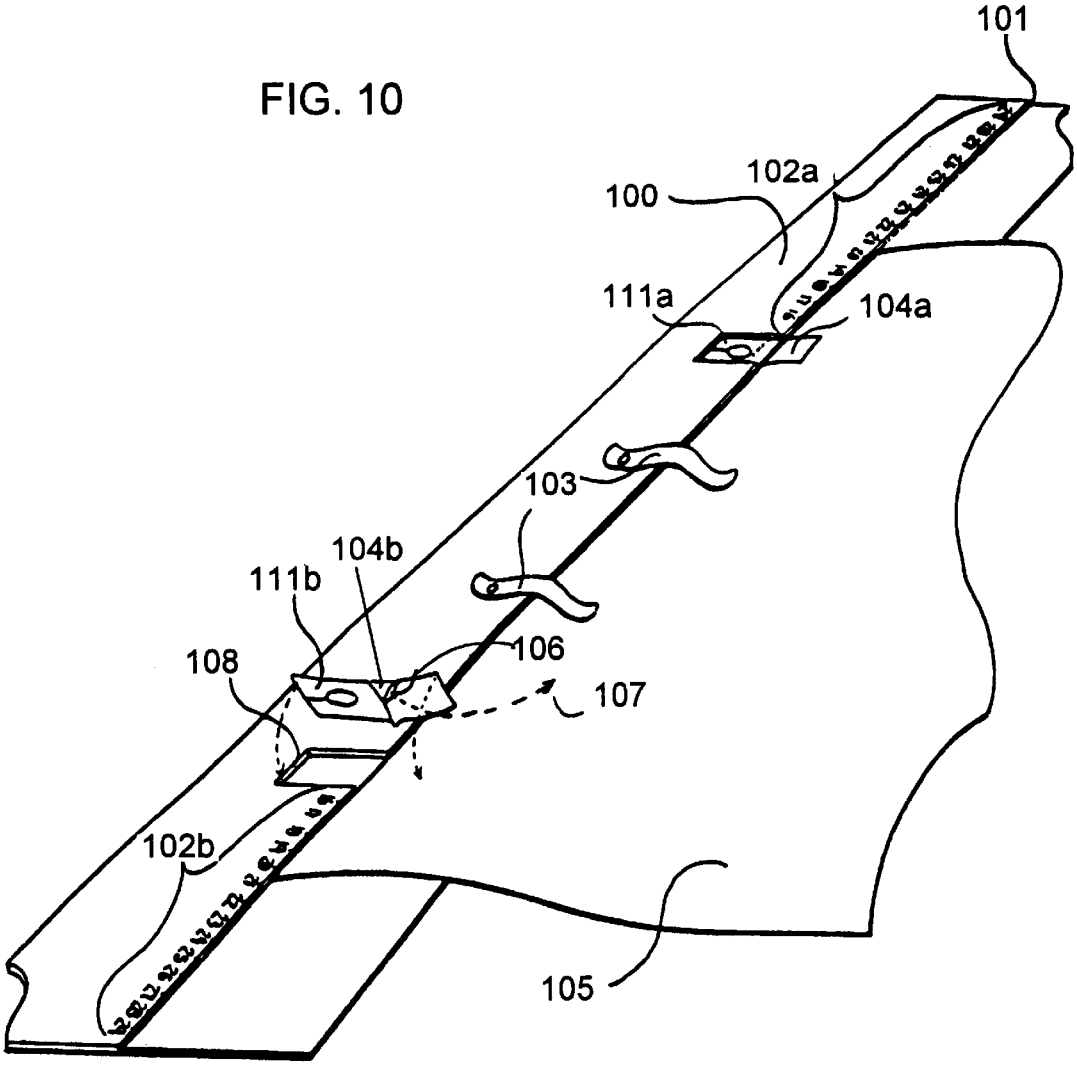

FIG. 10 is an illustration of a centering device for attaching tabs of the present invention to charts, posters, and the like.

Figure 11:
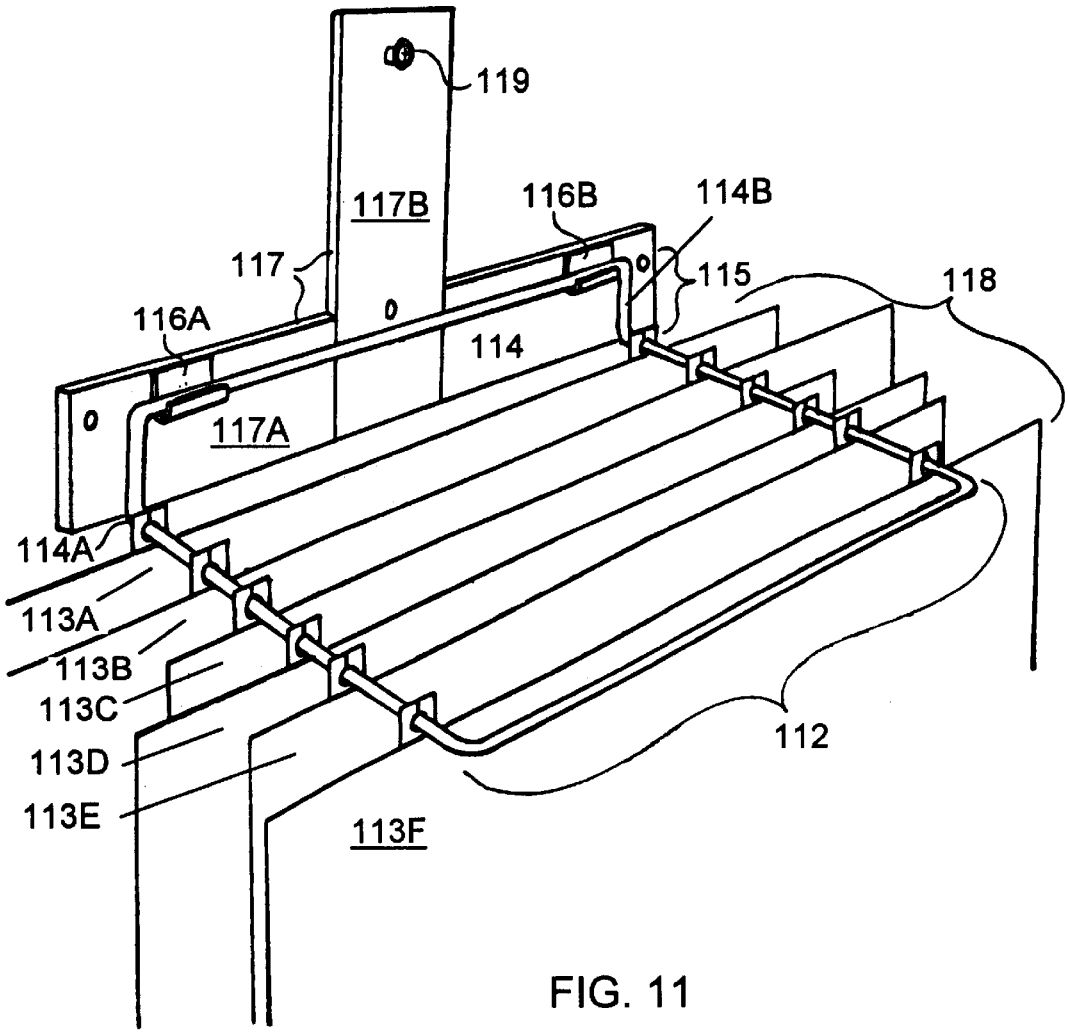

FIG. 11 is an illustration of a storage rack and the associated mounting plate in access position.

Figure 12:
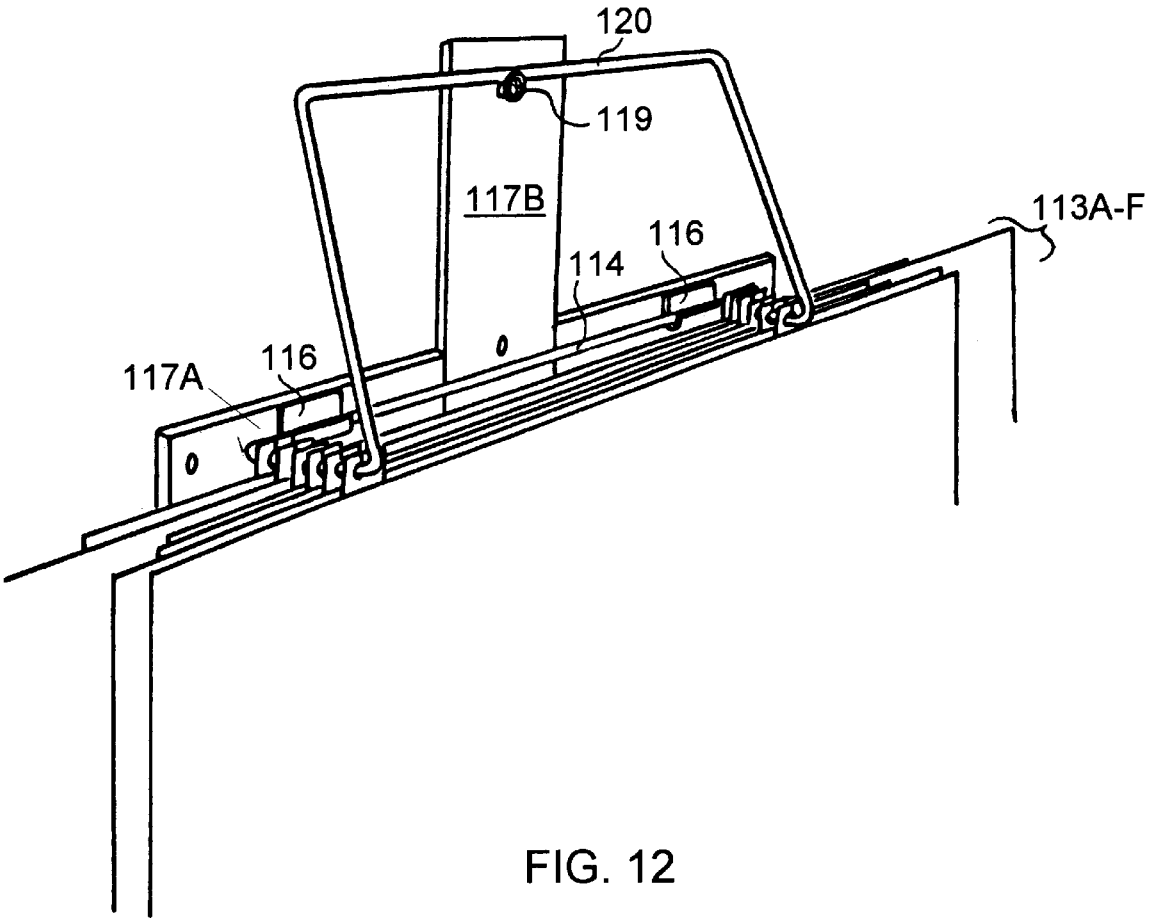

FIG. 12 is an illustration of the storage rack of FIG. 11 in storage position.

FIGS. 13A through 13H are various implementations of the mounting plate of the storage rack.

Figure 14A:
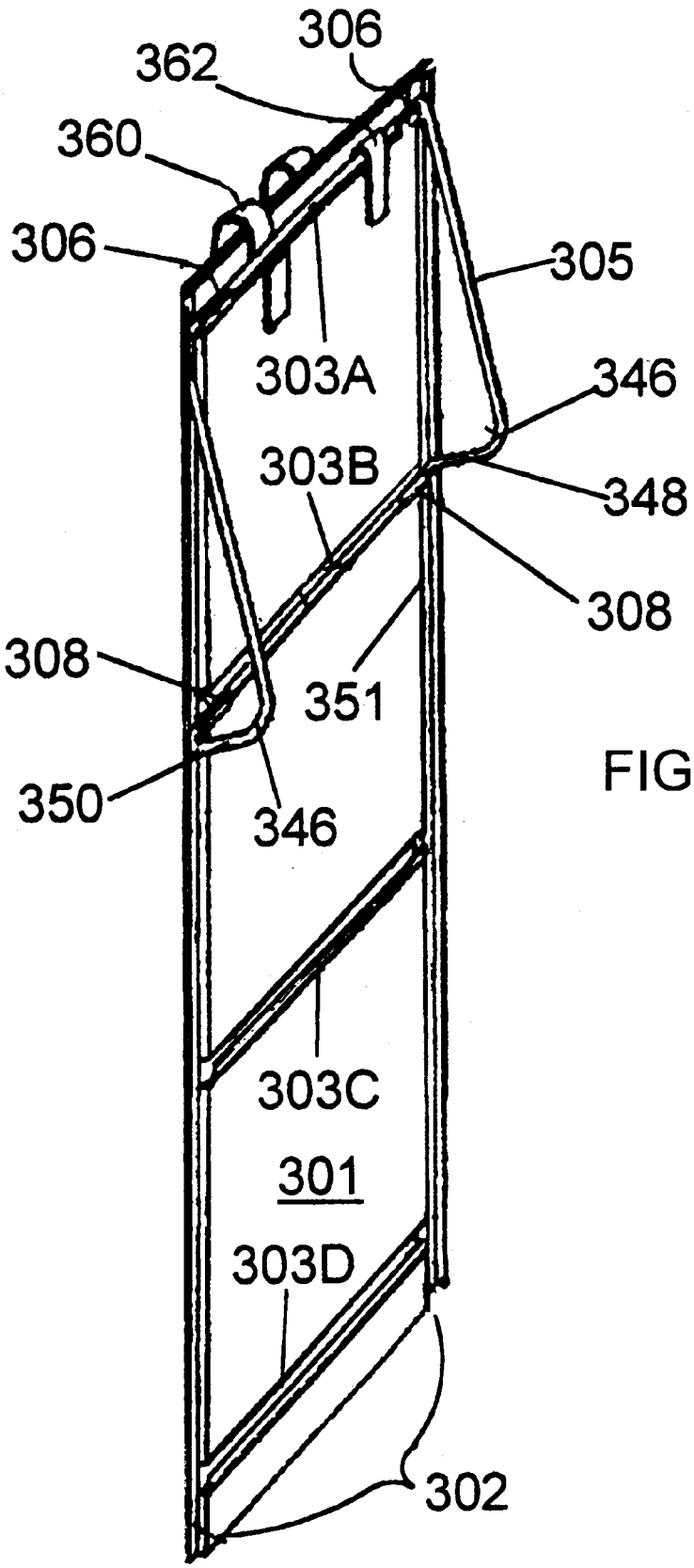
Figure 14B:
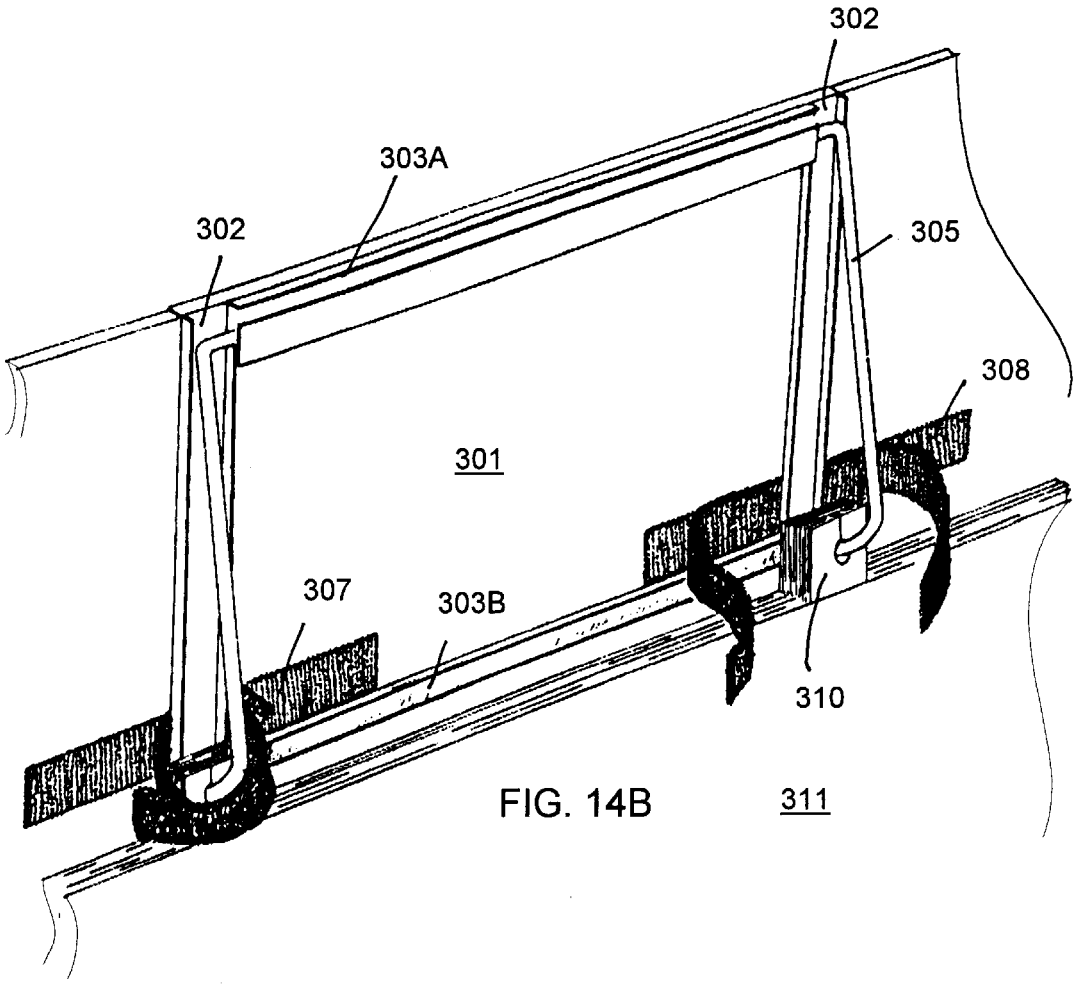

FIGS. 14A and 14B is a perspective view of the backing framework of the poster portfolio of the present invention.

Figure 15A:
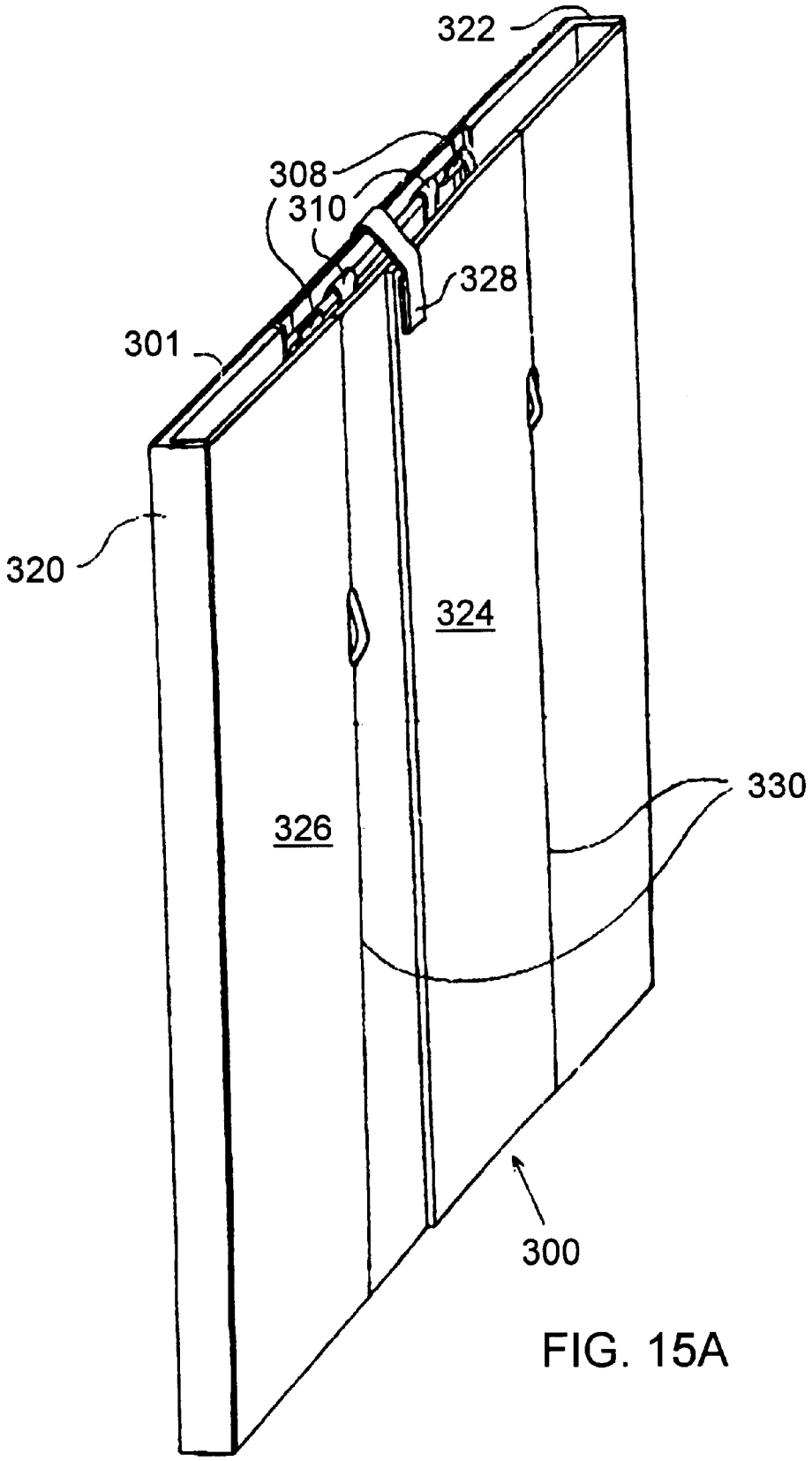

FIG. 15A is a perspective view of a closed free-standing poster portfolio of the present invention.

Figure 15B:
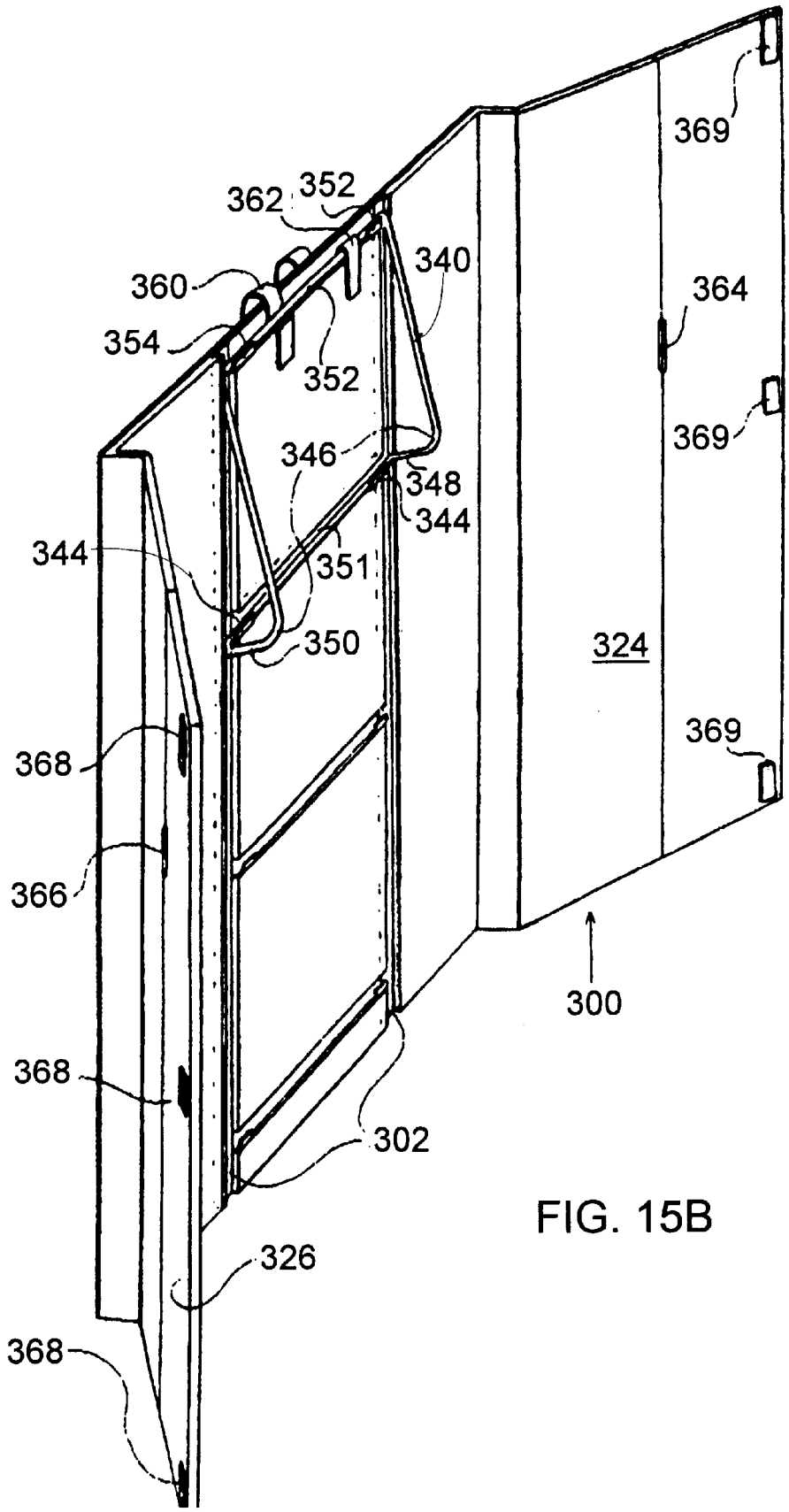

FIG. 15B is a perspective view of an opened free-standing poster portfolio of the present invention.

Figure 16A:
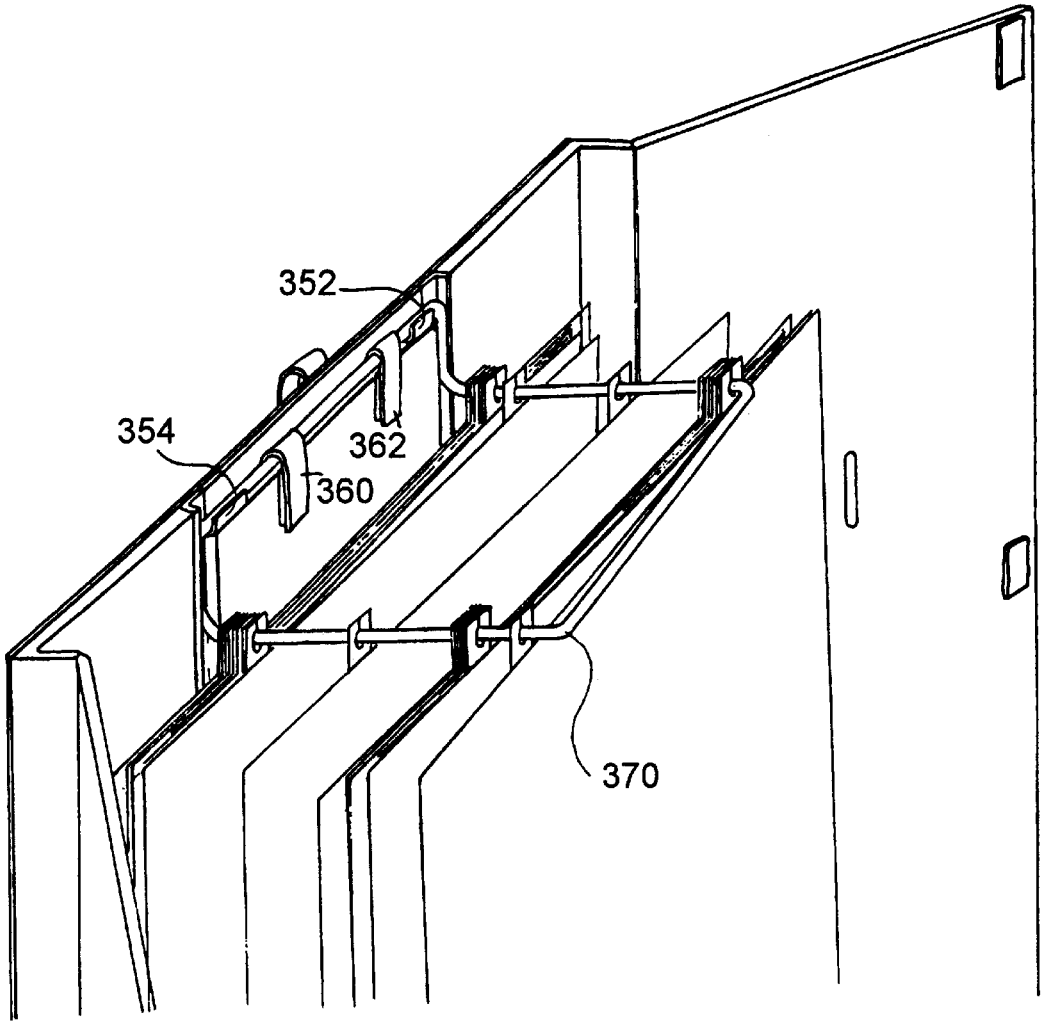

FIG. 16A is a perspective view of the free-standing poster portfolio with a storage rack in a first position.

Figure 16B:
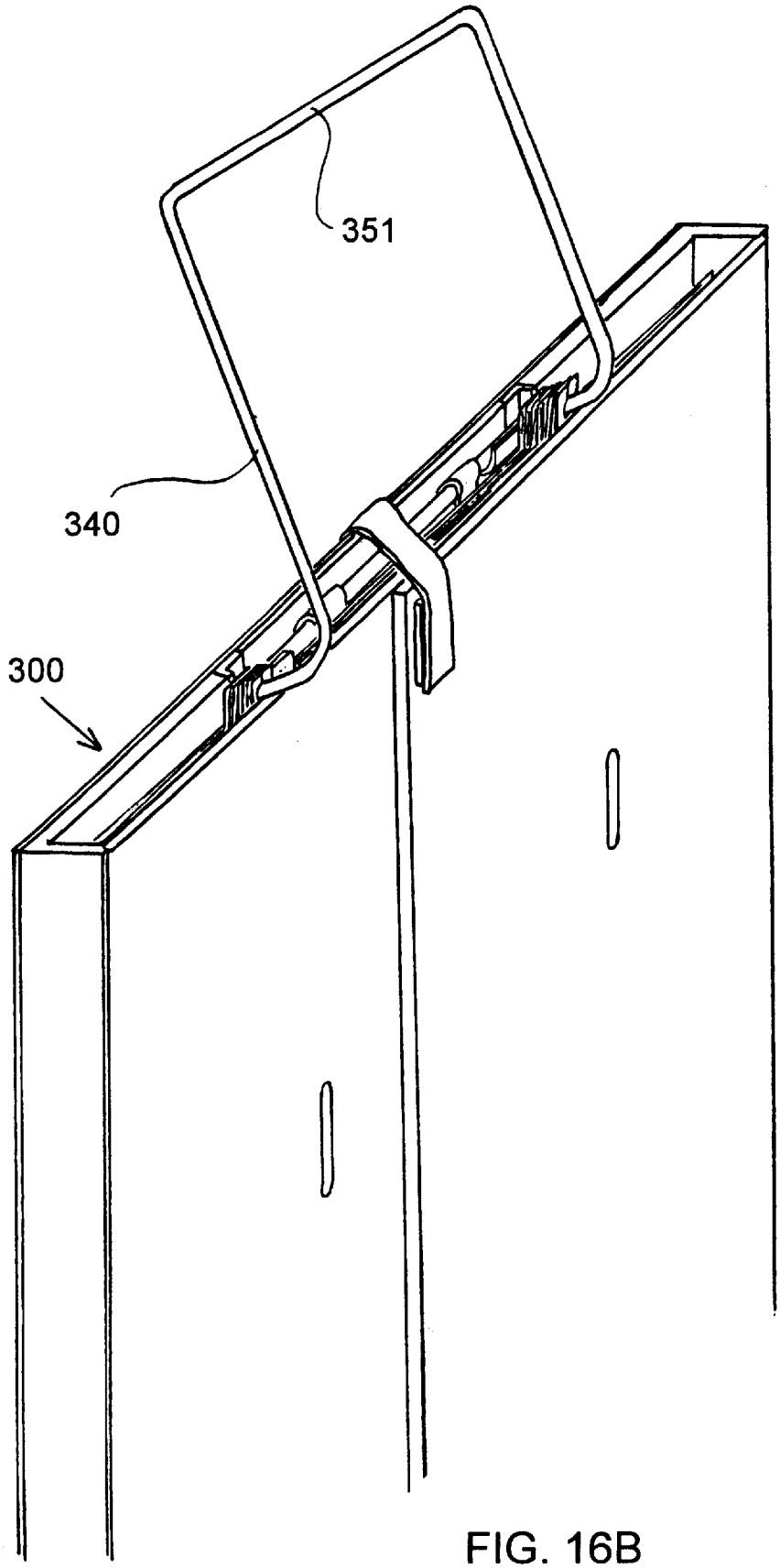

FIG. 16B is a perspective view of the free-standing poster portfolio with a storage rack in a second position.

DESCRIPTION OF THE PREFERRED EMBODIMENTS

Figure 1:
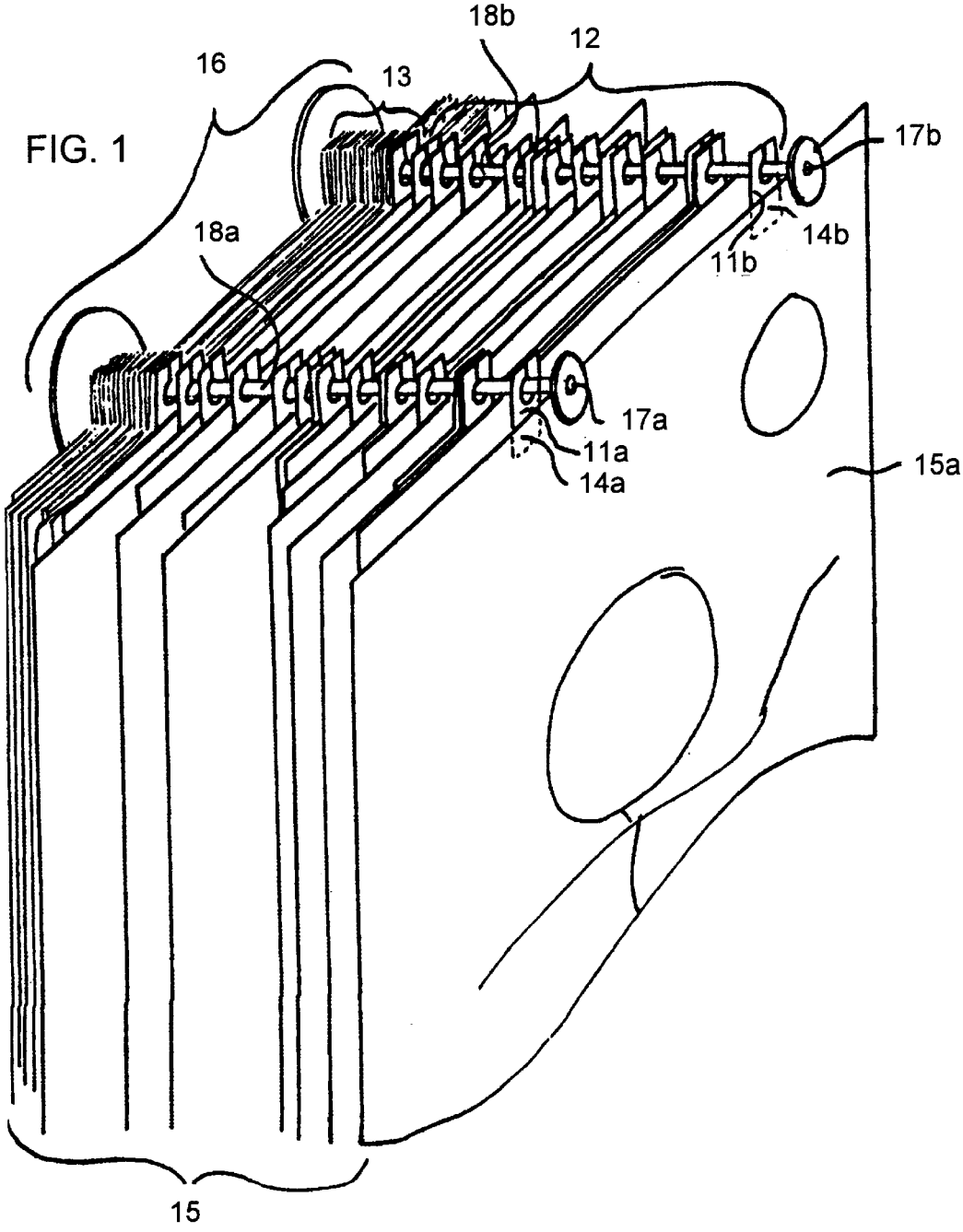
FIG. 1 is an illustration of posters hanging by precisely spaced tabs on a two rod rack.

FIG. 1 is an illustration of a plurality of posters 15 hanging on a two rod rack 16. In the preferred embodiment the rods 18*a* and 18*b* of rack 16 are spaced 14" apart, center to center. Wall mounts hold rods 19*a* and 19*b* and end stops 17*a* and 17 keep posters from sliding off. Tabs 11*a* and 11*b* are precisely spaced and centered on poster 15*a* to fit on the rods 18*a* and 18*b*. Most posters commonly used in the classroom measure at least 15" in one of their dimensions. And, for most posters, the maximum of the shorter side is 30". Spacing the tabs at 14" apart leaves a maximum of 7½" of poster top edge extending unsupported beyond the tabs on either side. Practically all posters are rigid enough so that the 7½" of unsupported extension will not sag. Those that would sag over time are generally kept straight by the adjacent posters, especially when bunched together as a group of posters 13. Tabs 11*a* and 11*b* of the preferred embodiment are 1" square and of 0.010" thick Mylar™ plastic. Transparent tape 14*a* and 14*b* is used to attach tabs 14*a* and 14*b* to a poster 15 and are generally about 0.0056" thick. Combined thickness of tape 14*a* and 14*b* and tabs 11*a* and 11*b* is thus about 0.0156 or 1/64". Therefore more than 60 posters can be held bunched together 13 on one inch of rod length. Posters may be spread out for review as demonstrated with posters of group 12. Size and design of the rack is important relative to the situation of use: amount and placement of space available, the number of posters to be stored, etc. However this disclosure addresses only the tabs and the essential element of supporting rods.

Figure 2:
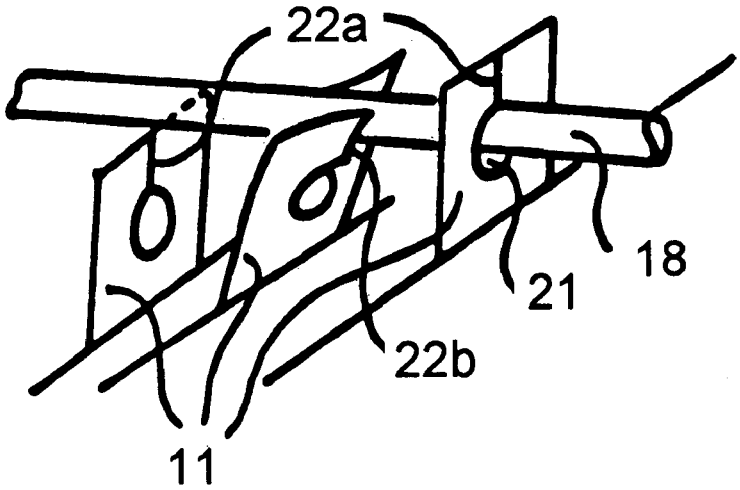
FIG. 2 is an illustration of the tab flexing open and snapping back into place onto the rod.

Attaching a poster with a tab of the present invention to a hanging rod is illustrated in FIG. 2. First and last tabs 11 have the slits 22*a* in normal closed position. The middle tab 11 is shown with an open slit 22*b* for moving the tab on or off rod 18. The rod's size may vary; in the preferred embodiment it is about ¼" and the hole 21 in the tab 11 is ⅜" allowing room for movement back and forth on the rod 18.

Figure 3:
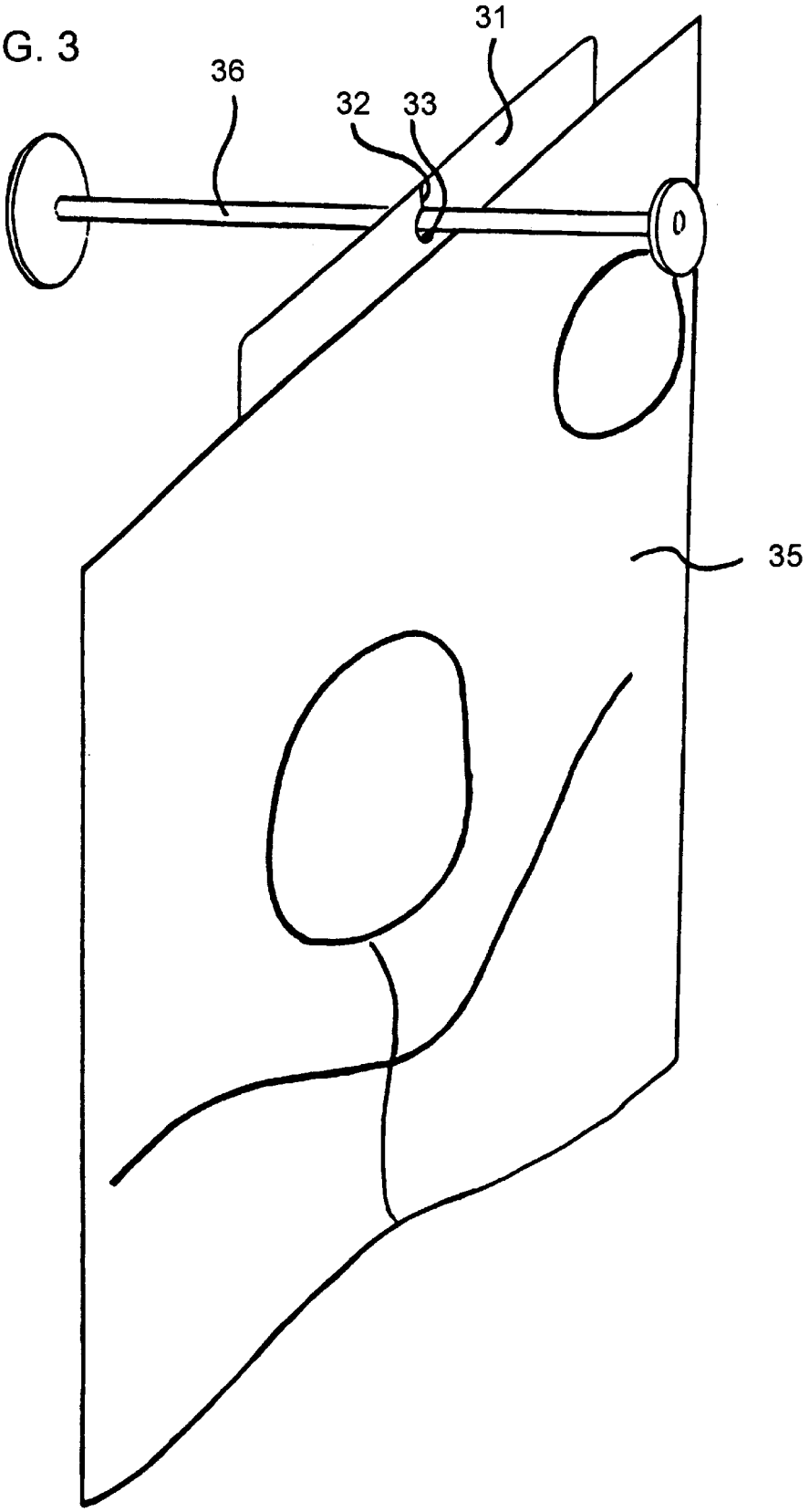
FIG. 3 is an illustration of a poster hanging by a long tab on a single rod rack.

FIG. 3 shows a poster 35 hanging on a single rod rack 36 by a long tab 31 with a single centered hole 33 and slit 32. A long tab 31 measures at least 15" long to accommodate the range of size and rigidity of posters as explained above for FIG. 1.

Figure 4:
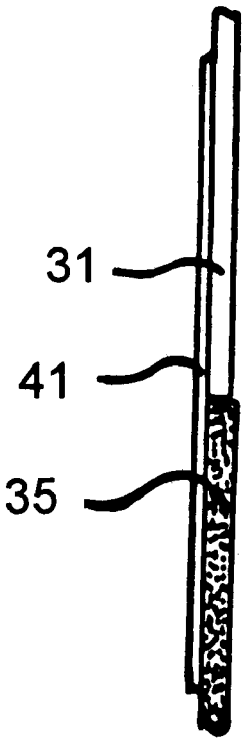
FIG. 4 is a side view of a tab being attached to a poster or chart.

FIG. 4 is a side view of a tab 31 which is attached to a poster 35 using an self-adhesive tap 41. It illustrates that tab 31 can be held within the thickness of poster 35, and that the extra thickness of tape 41 does not significantly decrease the capacity of a hanging rod or rods of a poster rack.

Figure 5:
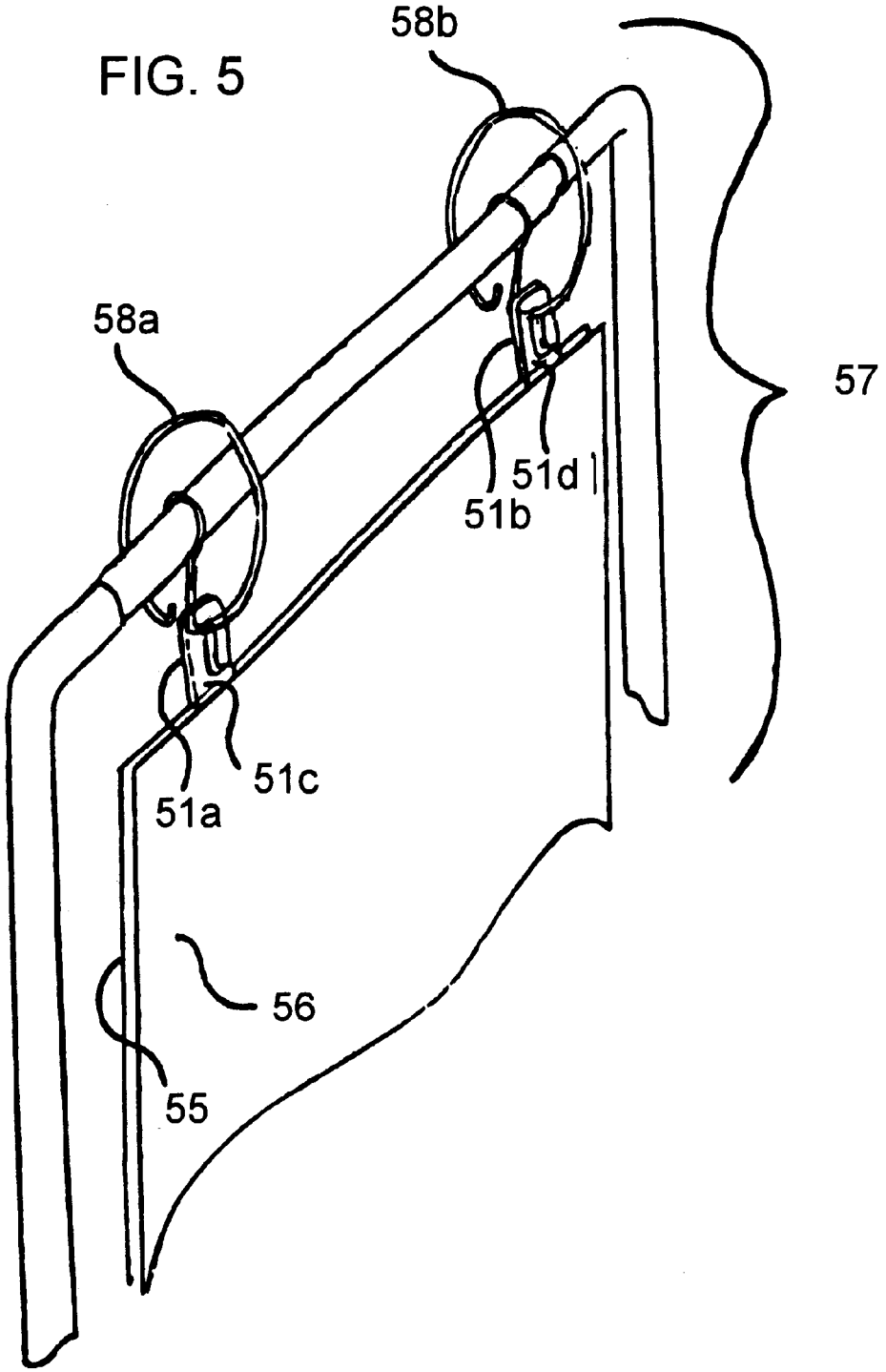
FIG. 5 is an illustration of the top portion a standard classroom rack for flip charts with two charts held by the flat plastic tabs of this invention hanging on the rings of the rack.

FIG. 5 is a view of the top portion a standard classroom rack 57 for flip charts. Two charts 55 and 56 held by flat plastic tabs 51*a* through 51*d* of this invention are hung on the rings 58*a* and 58*b* of rack 57. Chart 56 is in the front position, chart 55 is in the back position.

Figure 6:
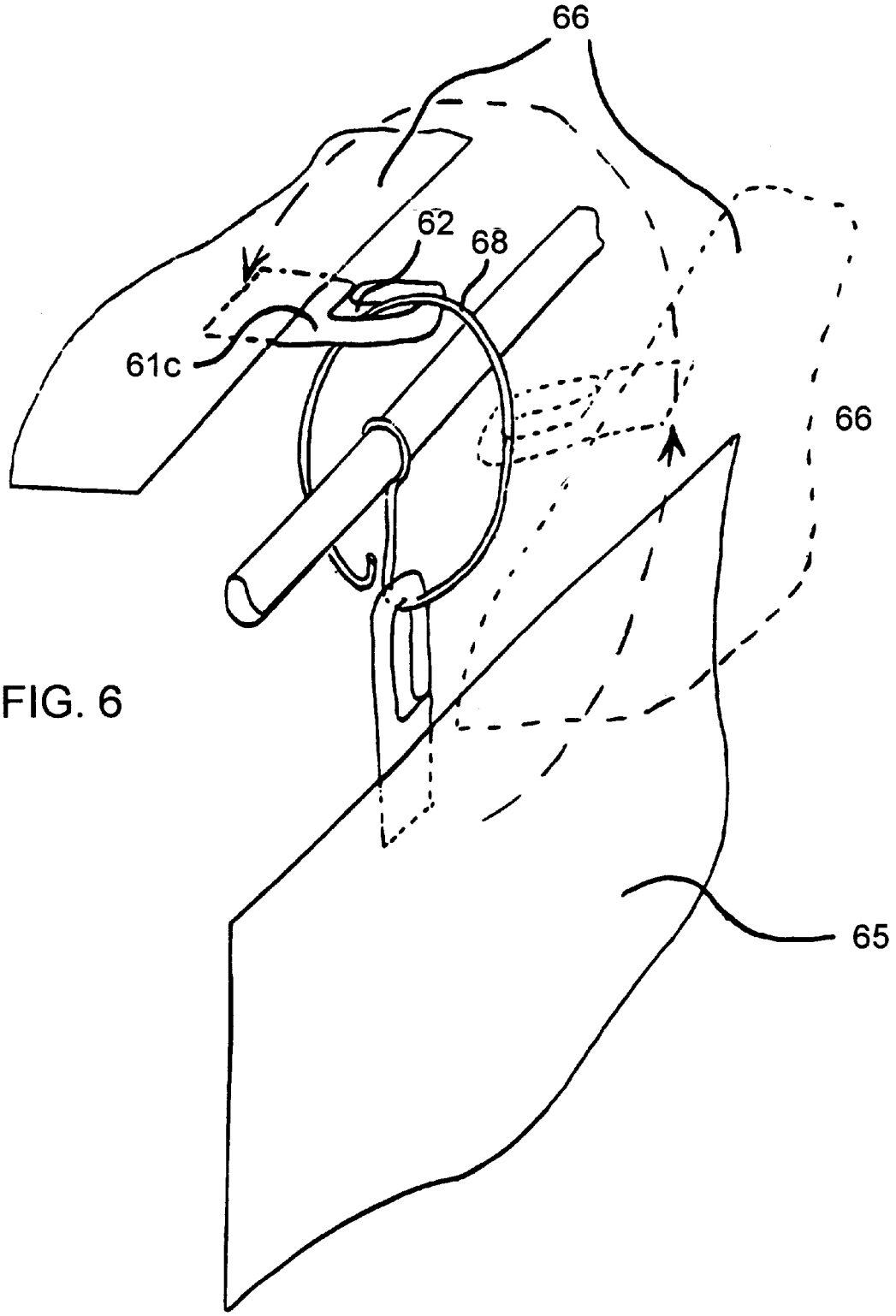
FIG. 6 is an illustration of the movement of the front chart held by a hook of this invention being flipped over the rack towards the back position.

FIG. 6 shows the movement of a front chart 66 held by hook 61*c* being flipped over the rack towards the back position. The elongated form of hole 62 provides room for movement along ring 68 avoiding binding friction even when hook 61*c* is angled tangentially in relationship to the ring 68.

Figure 7:
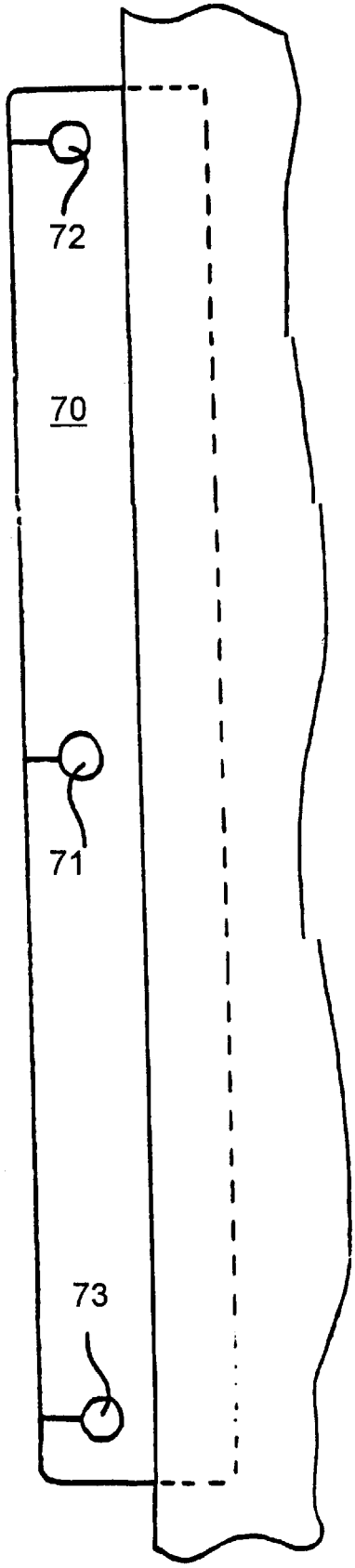
FIG. 7 is an illustration of a long tab with two alternative hole positions for use in combination with a single rod rack or a double rod rack.
Figure 8A:
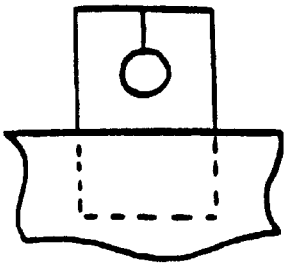
Figure 8B:
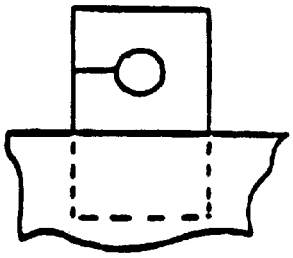
Figure 8C:
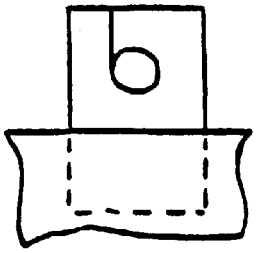
Figure 8D:
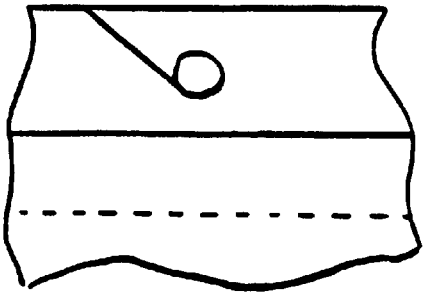
Figure 8E:
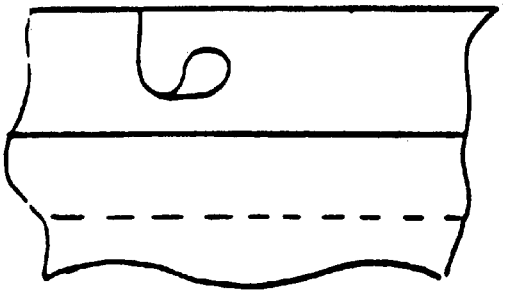

FIG. 7 shows a long tab 70 with two alternative hanging methods using three holes 71, 72, 73: one hole 7 in the center is a for single rod rack; two holes 71, 73 separated between their centers by 14" are provided for a double rod rack. The long tab 70 could be much wider to provide support for more flimsy materials such as thin paper or plastic bags.

FIGS. 8*a* through 8*e* are illustrations of alternative types of slits 81 through 85. Slits 82 through 85 could be more open slots, to the point of revealing a more traditional hook shape. Slit 81 could be a more open slot if it remains of lesser space than the supporting rod and to the extent that the material used were both flexible enough to allow the rod to pass, while rigid enough to provide support when hanging on the rod.

FIGS. 9*a* through 9*c* are illustrations of still other alternative types flip chart tabs 84 through 86 with slits 91 through 93 for flip charts 99*a* through 99*c*. The slot shape of the opening 97 is important to allow the tab to slide inclined tangentially to the ring as the chart is flipped over to the other side of the rack (as illustrated in FIG. 6). It was found that tab 95 is the most effective design allowing ease of placement and removal while still preventing accidental removal of the tab from a holding ring 58 (see FIG. 6).

FIG. 10 is an illustration of a centering device 100. A chart or poster 105 is shown face down, centered and held against alignment edge 101. Once poster 105 is centered, clips 103 hold the chart or poster 95 in position while tabs 111*a* and 111*b* are attached. One tab 111*a* has been attached by the simple addition of clear adhesive tape 104*a* attaching the tab 111*a* to the chart or poster 105. Another tab 111*b* with clear adhesive tape 104*b*, integrated during manufacture, is shown as the protective backing 107 is to be removed; tab 111*b* is to be positioned by placement to the guide notch 108 and the adhesive tape 104*b* applied to the back of the chart or poster 105.

A shown in FIGS. 1, 5 and 6 the objects to be hung for storage or for use as a flip chart can be hung on one or more rods or on rings. Rods and rings function as support hangers. The stile of the openings in the hanging tabs may be round for use on support rods, or may be elongated for use on either support rods or on support rings. In the later case, the elongated openings ease the flipping of the flip charts as disclosed with reference to FIG. 6.

FIG. 11 is an illustration of a storage rack and the associated mounting plate in selection position. The storage rack consists of a rectangular hanging frame 112, preferably made from round wire. In FIG. 11 there are shown 6 posters 113A through 113F hanging from rack frame 112 spaced apart for easy inspection. At the far end each side of rack frame 112 is bent by about 90 degree at bends 114, dividing frame 112 into an upper section 115 and a front section 118. Upper frame section 115 is provided to hanging frame 112 over hooks 116 of mounting plate 117*a*. As shown in FIG. 11 upper frame section 115 holds front section 118 in a substantially horizontal position, the selection position, for spreading apart stored posters 113A through 113F. Mounting plate 117*a* includes an extension 117*b* with a receiving hook 119. Hook 119 receives front end 120 of frame 112 to hold frame 112 and the stored objects in storage position as illustrated in FIG. 12. As is obvious from FIGS. 11 and 12 the storage rack of the present invention with the two positions, one for storing objects in a tight arrangement and a second position, the selection position for holding objects in a spread arrangement allows storage of many objects in a small space and allows to access individual objects without having to bend a stored object.

If a rack has to be moved, e.g. from the storage room to a classroom, it can easily be taken off hooks 116 and carried to another location were it can be mounted on a similar mounting plate.

Figure 13A:
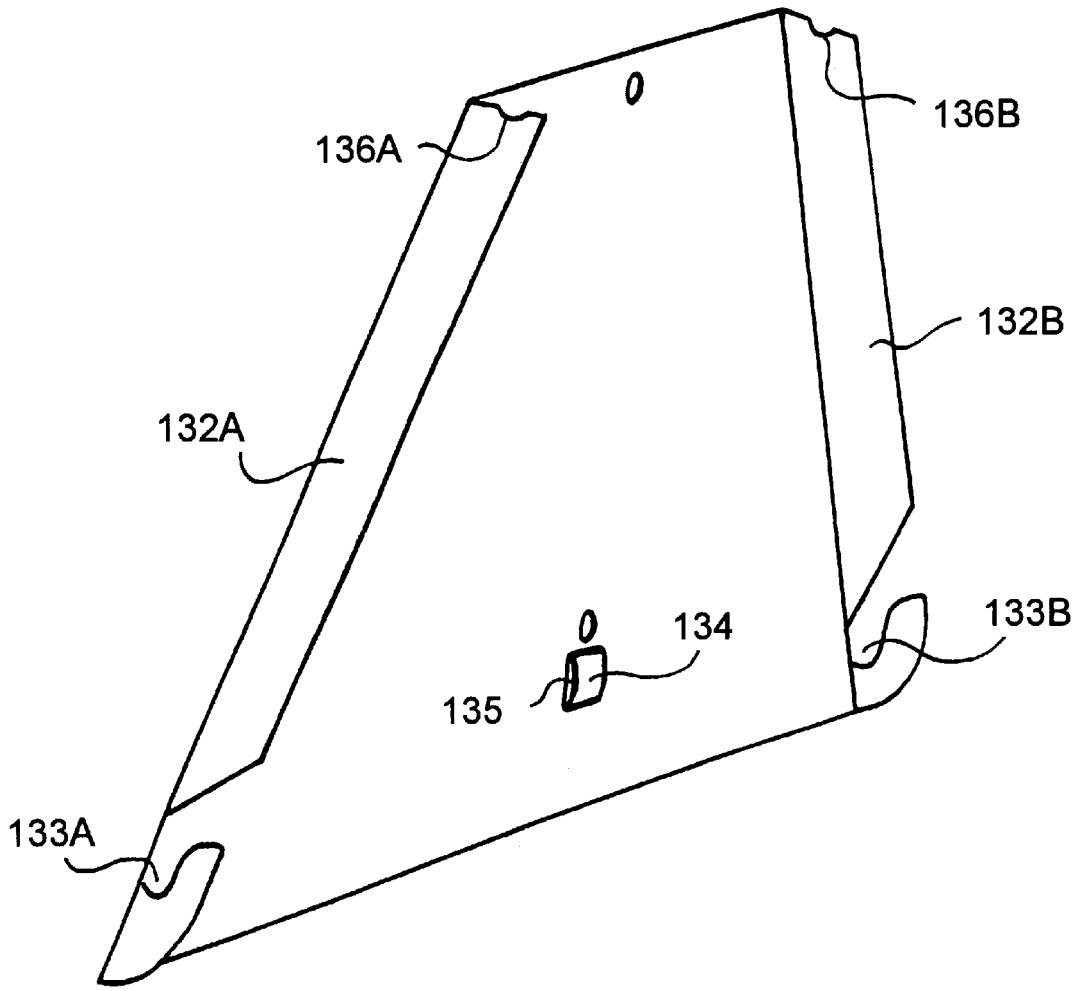
Figure 13B:
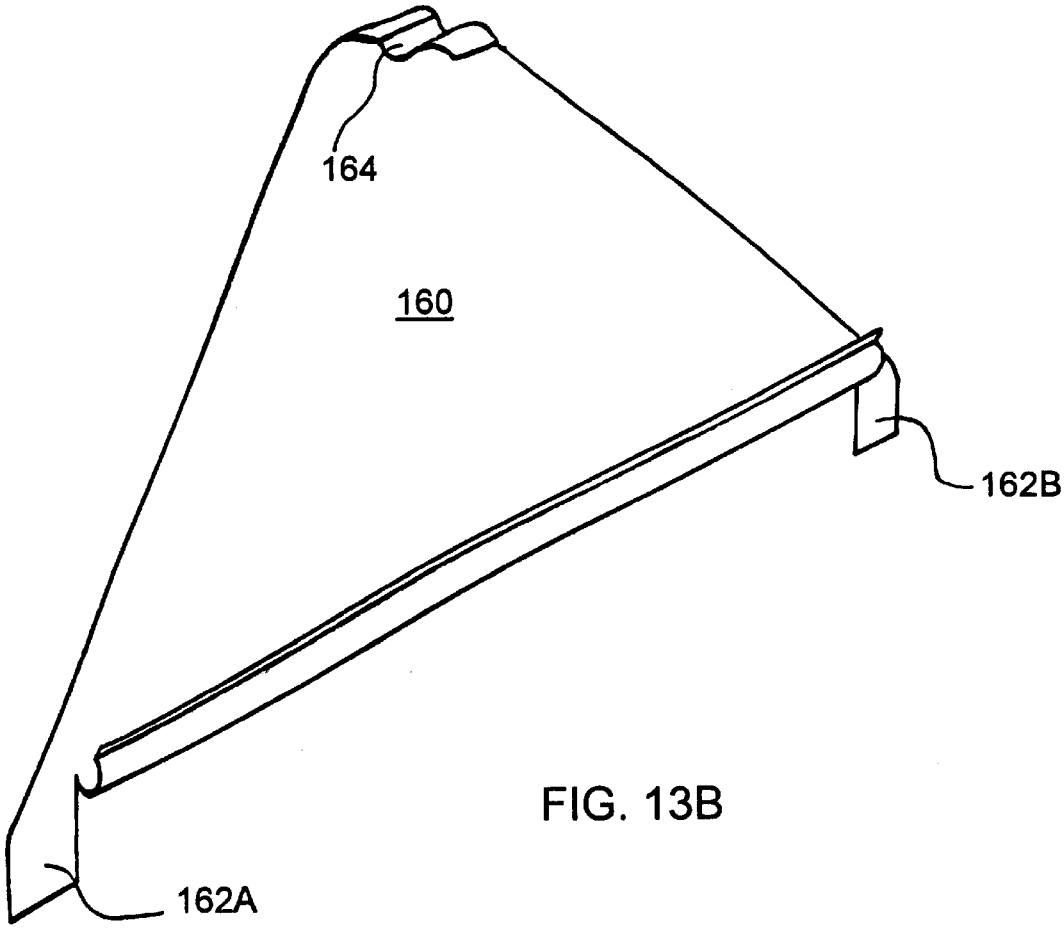

FIGS. 13A through 13H are various implementations of the mounting plate for the storage rack of the present invention. FIG. 13A is an illustration of a mounting plate 131 for receiving a storage rack frame 112. It is made from sheet material, e.g. metal or plastic, with two sides 132A and 132B being bend forward. Each of the forwardly bent sides 132A and 132B include a notch 133A and 133B, respectively, for receiving an upper frame section 115 of a frame 112, see FIG. 11. An elastic protrusion 134 locks a frame 112 in position. In FIG. 13A protrusion 134 is shown as a flat leaf spring protruding through an opening 135 in mounting plate 131. However, other solutions using wire springs and being mounted on the front side of mounting plate 131 are considered to be within the scope of the present invention. At the upper end of bent sides 132A and 132B there is each one notch 136A and 136B, respectively, for receiving front end 120 of a frame 112, see FIG. 12, to hold the frame 120 in storage position. Mounting plate 131 can be attached to any substantially vertical wall or to a stand or upright.

Wall plate 160 (FIG. 13B) has a 180 degree round bend 161 at the lower end and a hook 164 at the upper end. Bend 161 receives end section 115 of a frame 112. Hook 164 receives section 120 of a frame 112, when frame 112 is in storage position. A leaf spring 166 is provided to retain section 115 inside bend 161, unless overridden by forcefully moving section 115 out of bend 161. Straight straps 162*a* and 162*b* serve as stops for frame 120 when front section 118 is in horizontal position.

Figure 13C:
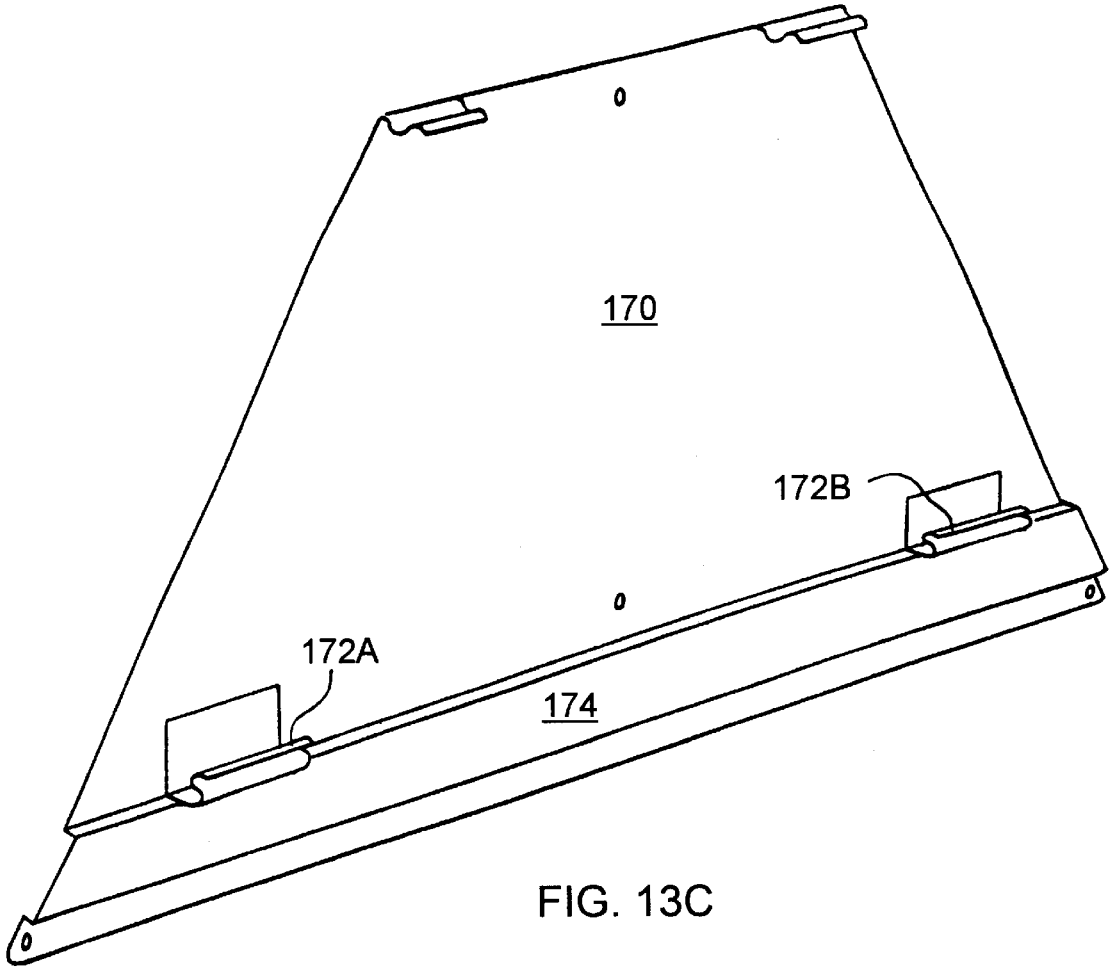
Figure 13D:
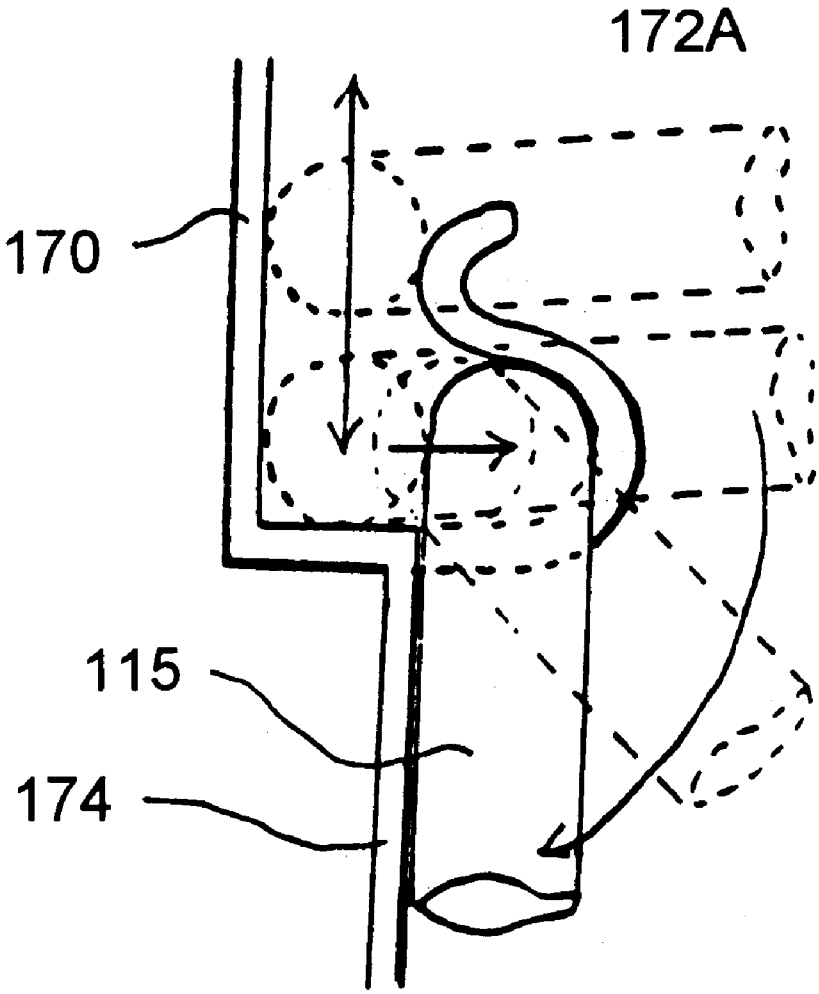

FIG. 13C is another design of a wall plate. Wall plate 170 has two lower hooks 172A and 172B. Below hooks 172A and 172B there is a forward bent section 174 of wall plate 170. This section, as can be seen in more detail in FIG. 13D ensures that frame section 115 of a frame 120 is locked on hooks 172A and 172B when in selection position. A frame 120 is inserted into hooks 172A and 172B with front section 118 in upright position, section 115 in horizontal position (see also FIGS. 11 and 12). Hooks 173A and 173B are provided for receiving front end section 120 to hold frame 112 in storage position.

Figure 13E:
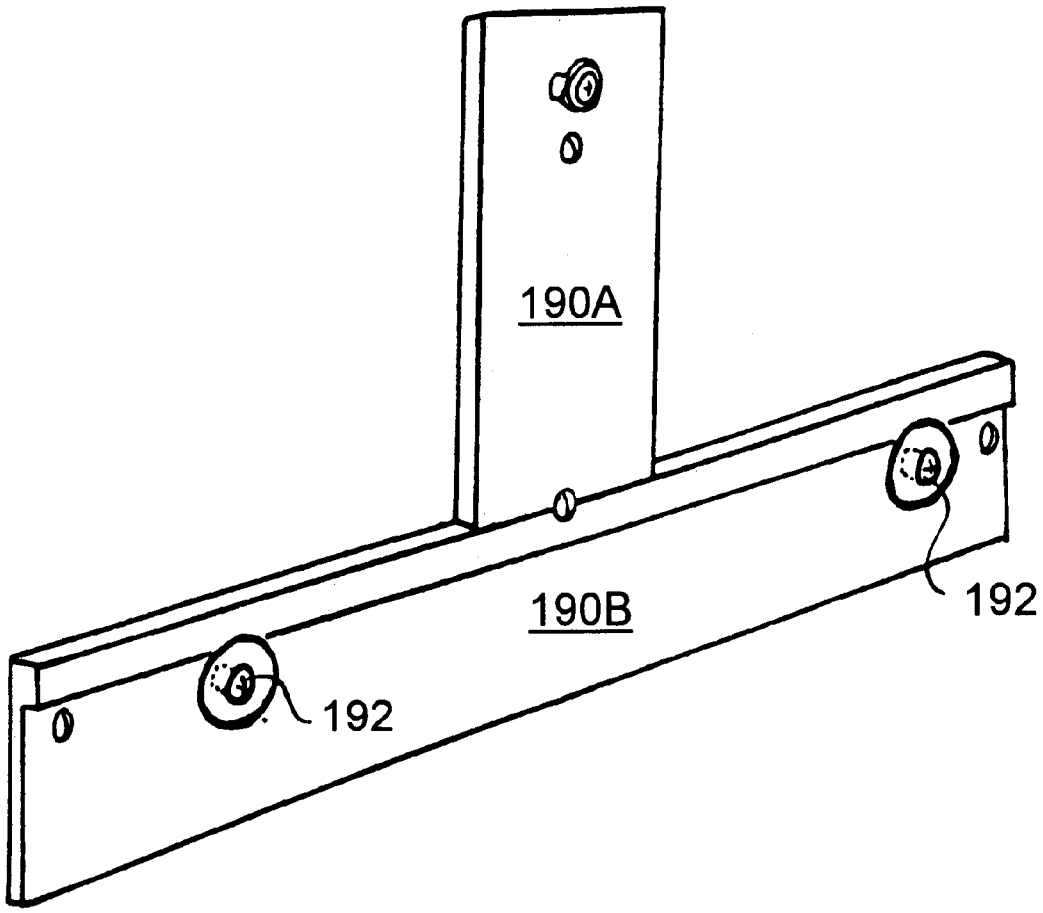
Figure 13F:
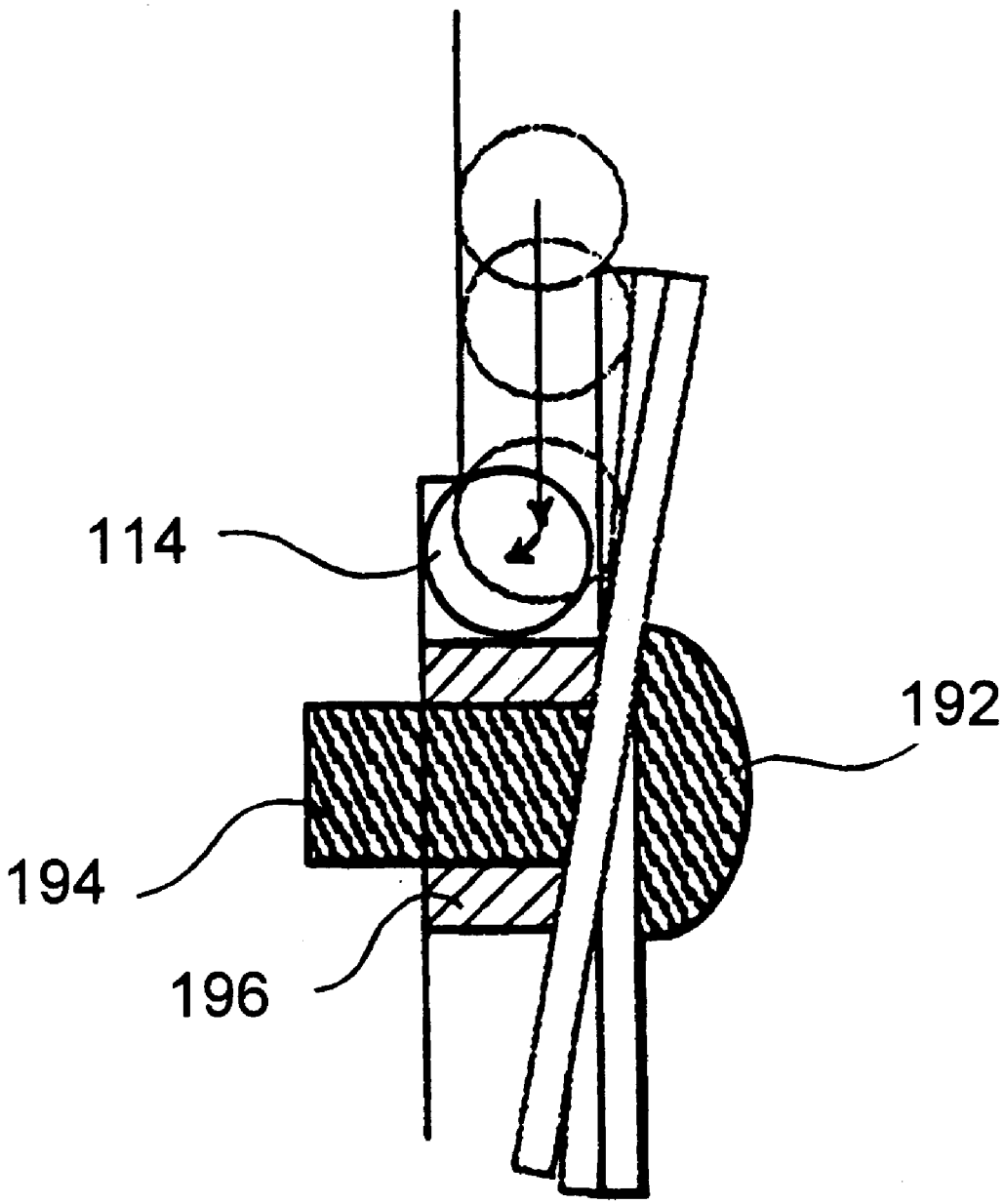

FIG. 13E is an illustration of a mounting plate. Mounting plate 190 is similar to mounting plate 117 of FIG. 11. However, instead of having hooks 116 this mounting plate 190 has two bolts 192 anchored in section 190B. On shaft 194 (see FIG. 13F) of each bolt 192 there is an elastic piece 196, tubing or compression spring, and between head 195 and elastic piece 196 there is a large washer 193. Along the upper end of section 190B thickness of the section is increased at a distance from elastic pieces 196 on bolts 194 to lock wire section 114 as shown in FIG. 13F. The distance depends on the thickness of section 114 of a frame 120.

Figure 13G:
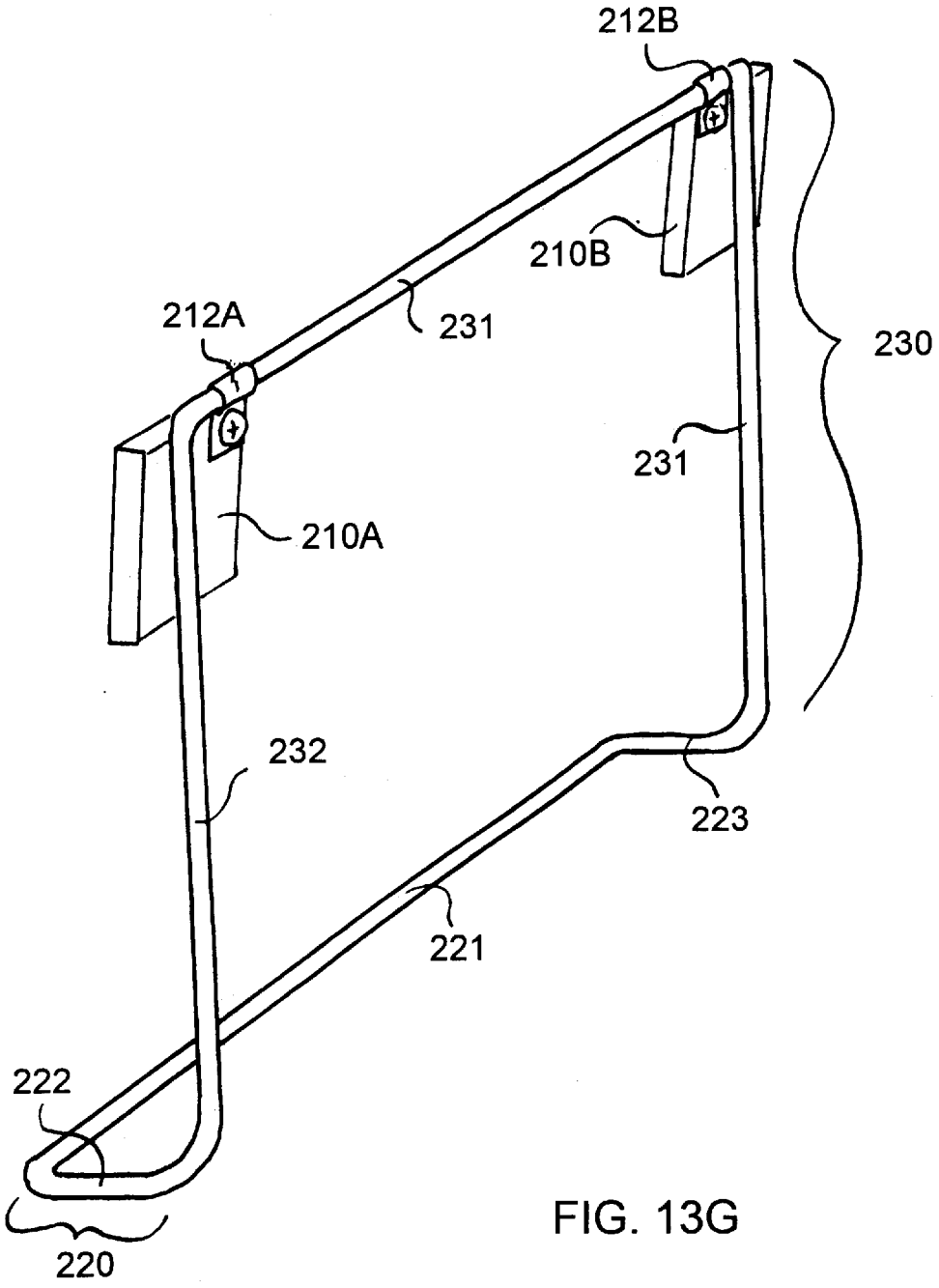

FIG. 13G is an illustration of the simplest implementation of the present invention, which consists of a frame 201 and two mounting plates 210A and 210B. (Posters not shown)

Frame 201 consists of a short frame section 220 and a long frame section 230. Short frame section 220 has a back end section 221 and two side sections 222 and 223. Long frame section 230 has a front end section 231 and two side sections 232 and 233. Side sections 222 and 223 are connected with side sections 232 and 233, respectively, under an angle of about 90 degree. The connecting section between connected side sections is curved to allow unimparred sliding of stored sheets from one frame section to another.

The material frame 201 is made of is of sufficient strength for carrying it with attached sheets of graphics or the like and for attache it to a mounting facility with either one of the end sections 221 or 231 in a storing position or a selection position, respectively.

Figure 13H:
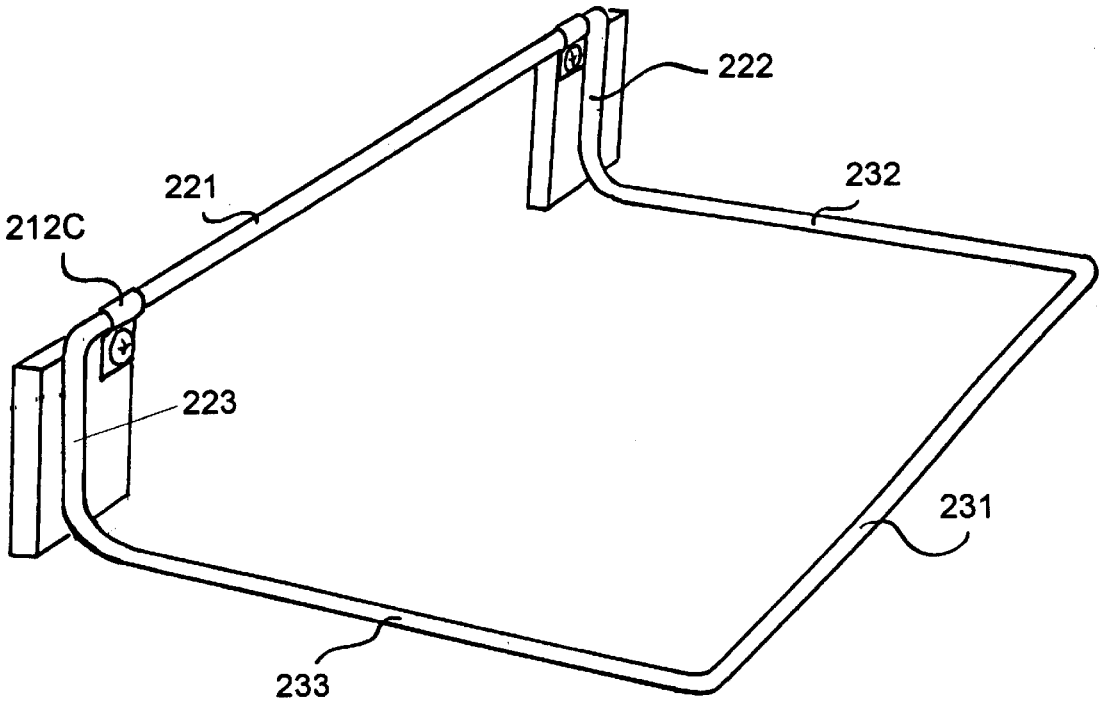

A mounting facility may consist of a single mounting plate, as illustrated in FIGS. 13A, 13B, 13C and 13E or two or more mounting plates. A set of two mounting plates and the manner of using the storage frame is shown in FIGS. 13G and 13H. Each such mounting plate has a sturdy hook 212A and 212B, respectively, for receiving front end section 231 (see FIG. 13G), or back end section 221 (see FIG. 13H). Mounting plates 210A and 210B may be mirror images of each other, as shown in FIG. 13G, or they may be symmetrical.

FIG. 13G illustrates the storage position of frame 201, FIG. 13H illustrates the selection position of frame 201.

The poster portfolio includes a firm support framework and backing and means for covering the stored posters during transportation. These means for covering are hinged to the backing and are also used to stabilize the poster portfolio in a freestanding application. The portfolio of the present invention uses a poster holding rack or frame, as disclosed above with reference to FIG. 11 and FIGS. 13G and 13H, to which posters can be attached by use of tabs as disclosed above. Such a rack or frame can be used in two positions, a first position for storing items such as posters, and a second position for holding items for selection, removal or adding of items.

FIG. 14A is a perspective view of the back frame of the poster portfolio of the present invention. On a semi-rigid back plane 301 there are mounted two rigid support rails 302 which provide for vertical rigidness of back plane 301. Rails 302 are spaced by cross-pieces 303A through 303D. Cross-piece 303A includes hooks 306. Cross-piece 303B includes hooks 308. Hooks 306 and 308 are provided to receive a frame 305 holding posters, as will be explained below. The spacing of rails 302 correspond to width of the frame 305 holding the posters. The width of backing 301 in FIG. 14 also corresponds to the width of frame 305. However, it may be expanded to the width of the portfolio. Instead of providing cross-pieces 303 and 304 with each two hooks 306 and 308, respectively, the cross-pieces 303A and 303B may each include a U-shaped channel for receiving end sections of frame 305.

FIG. 14B is a partial illustration of the back frame of the poster portfolio of the present invention and illustrates the the securing of a frame 305 in U-shaped channels of cross-pieces 303A and 303B using straps 307 and 308. Straps 307 and 308 are best mounted just above cross-piece 303B and should have width covering the space between the opening 309 of tab 310 and the top of the stored poster 311.

FIG. 15A is a perspective view of a closed poster portfolio 300 of the present invention. Rigidly attached to backing 301 are two sidewalls 320 and 322. A first cover piece 324 is rotatably attached to sidewall 322, and a second cover piece 326 is rotatably attached to sidewall 320. As shown in FIG. 15A, cover pieces 324 and 326 in closed position protect stored posters during transportation. Cover pieces 324 and 326 in opened position, as shown in FIG. 15B, secure portfolio 300 in a free-standing position. For improved access to stored posters cover piece 324 and 326 have folds 330. Cover pieces 324 and 326 overlap when closed over the stored posters, a closing strap 328 keeps portfolio 300 closed.

Closing strap 328 as well as securing straps 310 may be implemented using hook and loop interlocking material or other well known means to hold such straps in place.

FIG. 15B is a perspective view of an opened free-standing poster portfolio of the present invention. A frame or rack 340 is hung with cross bar 351 of its upper frame section, see FIG. 11, in lower position hooks 342 and 344. Elbow sections 346 protrude forwardly. Any posters stored would be suspended from the short sections 348 and 350 of frame 340. Frame 340 is held in upright position by slipping cross-bar 352 over upper position hooks 354 and 356. Cross bar 352 is securely held in hooks 354 and 356 by flaps 360 and 362, shown in open and closed position. Flaps 360 and 362 may be implemented using hook and loop interlocking material or other well known means to hold the straps in place.

To keep the thickness of portfolio 300 at a minimum, covers 324 and 326 include openings 364 and 366, which are properly positioned to receive elbows 346 of frame 340 when covers 324 and 326 are closed over back plane 301 (see also FIG. 15*a*). Additional interlocking means 368 on the outside of cover 326 and matching interlocking means 369 on the inside of cover 324 secure covers 324 and 326 in closed position. Instead of two hooks 354 and 356 cross bar 352 may include a U-shaped channel with a width not exceeding the inside width of frame 340.

FIG. 16A is a perspective view of the free-standing poster portfolio with a storage rack 370 secured in upper position hooks 352 and 354 in a selection or file access position for reviewing, adding or removing posters.

FIG. 16B is a perspective view of the free-standing poster portfolio with a storage rack mounted in the upper position hooks and turned upwards for carrying or hanging a closed poster portfolio 300 using cross bar 351 of frame 340 as a handle. Frame 340 is held in hooks 352 and 354 by flaps 352 and 354.

It is understood that it is considered to be within the skills of the artisan to design mounting plates with additional features such as artistic features to incorporate a mounting plate into a styled piece of furniture, or to add means to perform additional functions, e.g. protect a stored set of objects from dust.

What I claim is:

1. A free-standing chart portfolio storing a plurality of sheets of charts, comprising a chart holding frame for holding said plurality of charts;

said charts including holding tabs with slitted openings for attaching said charts to said chart holding frame;

an enveloping device including a back plane, a left side wall, a right side wall, a left cover and a right cover;

said left side wall being attached with a first edge to a left edge of said back plane, and having a second edge, said right side wall being attached with a third edge to a right edge of said back plane and having a fourth edge;

said left cover being attached to said second edge and being movable between a closed position and an open position through at least 90°, said right cover being attached to said fourth edge and being movable between a closed position and an open position through at least 90°;

said chart holding frame being removably attached to said enveloping device;

means for locking said left and said right cover in said closed positions, whereby said left cover and said right cover envelope and protect said plurality of charts;

said left cover and said right cover in said open positions extending forwardly at least 90° relative to said back plane providing for support of said portfolio in upright position and access to said means for holding said plurality of charts.

2. A free-standing chart portfolio storing a plurality of sheets of charts, as claimed in claim 1, wherein said left cover and said right cover each include two cover panels respectively hinged with each other and thereby extending opening space of said portfolio.

3. A free-standing chart portfolio storing a plurality of sheets of charts, as claimed in claim 1, wherein said enveloping device including means for selectively receiving said chart holding frame in a chart storage position and a chart selection position.

4. A free-standing chart portfolio storing a plurality of sheets of charts comprising a chart holding frame for holding said plurality of charts;

said charts including holding tabs with slitted openings for attaching said charts to said chart holding frame;

an enveloping device including a back plane, a left side wall, a right side wall, a left cover and a right cover;

said left side wall being attached with a first edge to a left edge of said back plane, and having a second edge, said right side wall being attached with a third edge to a right edge of said back plane and having a fourth edge;

said left cover being attached to said second edge and being movable between a closed position and an open position through at least 90°, said right cover being attached to said fourth edge and being movable between a closed position and an open position through at least 90°;

said chart holding frame being removably attached to said enveloping device;

means for locking said left and said right cover in said closed positions, whereby said left cover and said right cover envelope and protect said plurality of charts;

said left cover and said right cover in said open positions extending forwardly at least 90° relative to said back plane providing for support of said portfolio in upright position and access to said means for holding said plurality of charts; and means for securing said charts to said enveloping device, wherein said means for securing said charts reach around said tabs of said plurality of chart.

5. A free-standing chart portfolio storing a plurality of sheets of charts, as claimed in claim 4, wherein there is a space between said upper edge of said plurality of charts and said openings in said tabs, and wherein said straps have a width of about said space.

6. A free-standing chart portfolio storing a plurality of sheets of charts, comprising a chart holding frame;

a enveloping arrangement including a back, a left side, a right side, a left cover and a right cover, said left side being fixedly attached with a first edge to a left edge of said back, and having a second edge, said right side being fixedly attached with a third edge to a right edge of said back and having a fourth edge;

said left cover being attached to said second edge for rotation around said second edge from a closed position to an open position through at least 90°, said right cover being attached to said fourth edge for rotation around said second edge from a closed position to an open position through at least 90°;

said back including a first frame receiver and a second frame receiver for holding said chart holding frame selectively in a first or a second position, said chart holding frame having a first frame section and a second frame section, each of said frame sections having side sections and an end section connecting said side sections, said side sections of said first frame section being connected to corresponding side sections of said second frame section under an angle, said first frame section being shorter than said second frame section.

7. A free-standing chart portfolio comprising a chart holding frame;

a enveloping arrangement including a back, a left side, a right side, a left cover and a right cover, said left side being fixedly attached with a first edge to a left edge of said back, and having a second edge, said right side being fixedly attached with a third edge to a right edge of said back and having a fourth edge;

said left cover being attached to said second edge for rotation around said second edge from a closed position to an open position through at least 90°, said right cover being attached to said fourth edge for rotation around said second edge from a closed position to an open position through at least 90°;

said back including a first frame receiver and a second frame receiver for holding said chart holding frame selectively in a first or a second position;

said chart holding frame having a first frame section and a second frame section, said second frame section having two ends;

said first frame sections having side sections and an end section connecting said side sections, said side sections of said first frame section being connected to said two ends of said second frame section under an angle, said first frame section being shorter than said second frame section.

* * * * *